US007434506B2

(12) United States Patent
Wilson et al.

(10) Patent No.: US 7,434,506 B2
(45) Date of Patent: Oct. 14, 2008

(54) PROPANE BOTTLE RECYCLER

(76) Inventors: Wayne William Wilson, 5421 Larimer La., Billings, MT (US) 59105; Bradley Morris Fimrite, 2338 River Oaks Dr., Billings, MT (US) 59105; James Schmid, 3925 Coulson Rd., Billings, MT (US) 59101

( * ) Notice: Subject to any disclaimer, the term of this patent is extended or adjusted under 35 U.S.C. 154(b) by 630 days.

(21) Appl. No.: 11/228,082

(22) Filed: Sep. 17, 2005

(65) Prior Publication Data

US 2007/0062605 A1 Mar. 22, 2007

(51) Int. Cl.
*B30B 9/32* (2006.01)
*B65B 31/04* (2006.01)

(52) U.S. Cl. ..... 100/102; 100/45; 100/49; 100/215; 100/245; 100/98 R; 100/902; 100/100; 141/65; 141/98

(58) Field of Classification Search ..... 100/45, 100/49, 100, 102, 94, 98 R, 215, 218, 245, 100/902; 141/65, 98; 137/597
See application file for complete search history.

(56) References Cited

U.S. PATENT DOCUMENTS 4,459,906 A * 7/1984 Cound et al. ..... 100/45
5,067,529 A 11/1991 Gonzalez-Miller et al.
5,174,344 A 12/1992 Gonzalez-Miller et al.
5,322,093 A 6/1994 O'Neil
5,365,982 A 11/1994 O'Neill
5,371,911 A 12/1994 Mullinax
5,385,177 A 1/1995 O'Neil
5,406,691 A 4/1995 Thorne
5,441,088 A 8/1995 O'Neill et al.
5,469,898 A * 11/1995 Campbell ..... 141/65
5,488,899 A 2/1996 Jennings et al.
5,613,533 A 3/1997 Gold et al.
5,657,800 A * 8/1997 Campbell ..... 141/98
5,839,350 A 11/1998 Mefferd et al.
6,178,882 B1 1/2001 Wagner et al.
6,308,618 B1 10/2001 Richard et al.
6,729,364 B2 * 5/2004 Few et al. ..... 141/65
6,772,497 B2 8/2004 Rice et al.

* cited by examiner

*Primary Examiner*—Jimmy T Nguyen
(74) *Attorney, Agent, or Firm*—Antoinette M. Tease

(57) ABSTRACT

A propane bottle recycler comprising a bottle station, first and second propane collection tank, compressor, liquid propane storage tank, bottle crusher, and crushed bottle storage compartment. The bottle station comprises a bottle manifold and bottle station frame, and the bottle manifold is pivotally connected to the bottle station frame. Propane bottles are placed in receiving cavities in the bottle manifold and held in place with cam levers, and the bottle manifold is raised to a vertical position. The propane drains out of the propane bottles, through propane hoses into a propane manifold, into the first and second collection tanks, and to a compressor, which repressurizes the propane. The propane is then stored in a liquid propane storage tank. The used propane bottles are crushed by the bottle crusher and stored in the crushed bottle storage compartment.

19 Claims, 20 Drawing Sheets

PROPANE BOTTLE RECYCLER

BACKGROUND OF THE INVENTION

1. Field of the Invention

The present invention relates to the field of recycling technologies, and more particularly, to a propane bottle recycler that recycles not only the propane containers but also the propane itself.

2. Description of the Related Art

Propane and various blends of propane are generally stored in small steel or aluminum bottles for use in lanterns, camp stoves, camping heaters, and similar propane-burning devices. The propane is stored in the bottle under high pressure in a liquid state. Because propane has a boiling point of −44° Fahrenheit, the propane vaporizes as it exits the bottle. Although there are refillable propane tanks, the typical propane bottle is a DOT 39 cylinder. DOT 39 cylinders are non-refillable, and they must meet certain criteria (for example, ability to withstand pressure) established by the Department of Transportation.

Because propane bottles are often used in connection with camping, national parks are challenged with how to safely dispose of used propane bottles. Traditionally, used propane bottles have been thrown in garbage collection bins along with other garbage, but the propane bottles pose special problems because if punctured, they could explode, and they cannot be composted along with other, compostable garbage. There is one device on the market (the PROSOLV® propane cylinder recycling system made by Justrite Manufacturing) that empties the propane from within the container and then recycles the cylinders as scrap steel, but it is a manual system, it can only be used with one container at a time, and it is not sufficient to address the needs of national parks, which deal with thousands, if not millions, of these bottles per year. In addition, with the PROSOLV® device, the propane is collected in a carbon canister, which absorbs the propane, and then thrown away. The propane itself is not recycled.

There are no issued patents or published patent applications that provide a solution to the problem of recovering the propane inside a closed, non-refillable propane bottle while at the same time crushing the propane bottle so that it can be used as scrap steel—and doing all of this in mass quantities. In the United States alone, 40 million one-pound propane bottles are consumed each year. The steel wasted from throwing away old propane bottles could produce enough recycled steel to build approximately 8000 automobiles annually. Furthermore, the empty steel bottles take up approximately 3.3 million cubic feet of landfill space every year. These problems have not been solved by existing art.

U.S. Pat. No. 5,613,533 (Gold et al., 1997) provides a waste cylinder rupture vessel that is used for releasing and recontaining toxic contents of compressed gas cylinders. The containers are punctured, and the contents of the containers are released into a vacuum chamber. The released gases are then pumped into a second chamber, where they are pumped into new gas cylinders. One of the purposes of this invention is to provide an environmentally acceptable manner of disposing of deteriorated compressed gas cylinders when the contents of the cylinders are unknown.

U.S. Pat. No. 5,441,088 (O'Neill et al., 1995) and U.S. Pat. No. 5,365,982 (O'Neill) disclose a liquid petroleum gas can recycling apparatus that recovers residual gas (such as propane) from used cans. The propane or other liquefied petroleum might be used as a propellant in an aerosol can, or it might be used as a cooking gas. The used cans are placed in a hopper and released one at a time into an inclined feed chute, which leads to a compaction chamber. The compaction chamber is sealed, air is removed from the chamber to avoid explosion, and then the bottom of the can is pierced. The contents of the can exit through the hollow piercing needle into a line for collection and/or recycling, and the can is crushed. This invention was intended to allow for the recycling of propane in countries such as Japan, where reliquefication of residual liquefied petroleum gas (such as propane) is prohibited. Thus, the goal of this invention was to extract the residual cooking gas for recovery and re-use without reliquefying the gas.

U.S. Pat. No. 5,385,177 (O'Neil, 1995) and U.S. Pat. No. 5,322,093 (O'Neil, 1994) both relate to an invention similar to the one described immediately above, except that they include a propellant collection tank for cooling and liquefying the propellant prior to collection.

U.S. Pat. No. 5,067,529 (Gonzalez-Miller et al., 1991) and U.S. Pat. No. 5,174,344 (Gonzalez-Miller et al., 1992) involve another invention directed toward removing the propellant in an aerosol can. This invention is an apparatus that depressurizes, de-caps, and recycles aerosol cans by lowering a vacuum head onto the can top, puncturing the can cap member with a hollow needle, and removing the propellants and other gaseous contents of the can by drawing them through the hollow needle into a storage container.

There are several others patents that deal with crushing and recycling oil filters, processing storage drums, cleaning and crushing cans prior to recycling, and compacting containers of flowable materials (such as food or paint). Examples of such inventions include U.S. Pat. No. 6,772,497 (Rice et al., 2004), U.S. Pat. No. 5,839,350 (Mefferd et al., 1998), U.S. Pat. No. 5,406,691 (Thorne, 1995), U.S. Pat. No. 5,371,911 (Mullinax, 1994), U.S. Pat. No. 5,488,899 (Jennings et al., 1996), U.S. Pat. No. 6,178,882 (Wagner et al., 2001), and U.S. Pat. No. 6,308,618 (Richard et al., 2001). All of these inventions involve the processing of non-pressurized cans or containers that are open to the environment, as opposed to propane cylinders, which are pressurized and closed.

BRIEF SUMMARY OF THE INVENTION

The present invention is a propane bottle recycler comprising a bottle station, a first propane collection tank, and a liquid propane storage tank, wherein the bottle station comprises a bottle manifold, a bottle station frame, a plurality of propane hoses, and a propane manifold, wherein the bottle manifold is pivotally connected to the bottle station frame so that the bottle manifold can be raised to a vertical position or lowered to a horizontal position, wherein the bottle manifold comprises a bottle header and a plurality of bottle cradles, wherein the bottle header comprises a plurality of receiving cavities, wherein the sides of the receiving cavities are not threaded, wherein the number of receiving cavities equals the number of bottle cradles, wherein the number of propane hoses equals the number of bottle cradles, wherein one or more propane bottles is/are placed in the bottle cradle(s) when the bottle manifold is in a horizontal position, with one propane bottle per bottle cradle, wherein each propane bottle comprises a mouth, wherein the mouth of each propane bottle is inserted into a receiving cavity, wherein each receiving cavity comprises a propane evacuation nipple, wherein the bottle manifold is raised to a vertical position so that the bottle mouths are facing downward, wherein the propane from each bottle flows through the propane evacuation nipples, through a valve on the opposite side of the bottle header, and into one of the propane hoses, wherein the propane flows from the propane hoses into a propane manifold, wherein the propane flows from the propane manifold into a first propane collection tank, wherein the propane flows from the first propane collection tank into a compressor, wherein the propane is in gaseous form when it flows into the compressor, wherein the compressor repressurizes the propane, and wherein the liquid propane flows from the compressor into a liquid propane storage tank.

The propane bottle recycler of the present invention further comprises a means for holding the bottles in place in the bottle cradles. The means for holding the bottles in place in the bottle cradles may be a plurality of cam levers. Alternately, it may be a plurality of spring-loaded plungers. The number of cam levers or spring-loaded plungers equals the number of bottle cradles. Each cam lever comprises a rod and a rubber stopper.

The present invention optionally comprises a heat exchanger, wherein the heat exchanger is positioned between the compressor and the liquid propane storage tank, and wherein the heat exchanger reduces the temperature of the propane as it exits the compressor. A second propane collection tank is also optional. The second propane collection tank is positioned between the first propane collection tank and the compressor, and wherein the propane flows from the first propane collection tank into the second propane collection tank and then into the compressor.

In one embodiment, the present invention further comprises a plurality of solenoid valves, wherein the number of solenoid valves equals the number of bottle cradles, wherein there is a solenoid valve located on the opposite side of the bottle header from each receiving cavity, and wherein the solenoid valves control the flow of propane from the propane bottles into the propane hoses. The solenoid valves are controlled by an electrical switch, and wherein the switch is activated when the bottle manifold is raised to a vertical position. The compressor creates a vacuum between the solenoid valves and the compressor.

In another embodiment, the present invention further comprises a plurality of one-way valves and a single solenoid valve, wherein the number of one-way valves equals the number of bottle cradles, wherein there is a one-way valve located on the opposite side of the bottle header from each receiving cavity, wherein the one-way valves allow the propane to flow out of the propane bottles and into the propane hoses but prevent the propane from traveling in the opposite direction, and wherein the solenoid valve controls the flow of propane from the propane manifold into the first propane collection tank. The solenoid valve is controlled by an electrical switch, and wherein the switch is activated when the bottle manifold is raised to a vertical position. The compressor creates a vacuum between the solenoid valves and the compressor.

The present invention further comprises a bottle crusher and a crushed bottle storage compartment. The bottle crusher comprises a bottle crusher tube, a hydraulic motor, a hydraulic cylinder, a hydraulic ram, a sliding plate, a first switch, a second switch, a crushing area, a feed area, a lateral post, a crushing face, and a backstop, wherein the bottle manifold is lowered to a horizontal position and the bottles are removed from the bottle cradles and placed into the bottle crusher tube after the propane is drained from the bottles, wherein when one or more bottle(s) is/are placed inside the bottle crusher tube, one bottle will fall down into the crushing area, wherein the sliding plate prevents more than one propane bottle from being in the crushing area at a time, wherein the sliding plate moves back and forth in a horizontal direction, and when the sliding plate is withdrawn from the bottle crusher tube, the next bottle in line falls into the crushing area, wherein the movement of the sliding plate is controlled by the first and second switches, wherein the crushing face is located directly underneath the sliding plate, wherein the sliding plate and crushing face are both moved by the hydraulic ram, wherein the hydraulic ram is moved by the hydraulic cylinder, wherein the hydraulic cylinder is powered by the hydraulic motor, wherein the crushing face comprises one or more spike(s), wherein the spike(s) puncture the side of the propane bottle that is located in the crushing area and the crushing face crushes the bottle against the backstop, and wherein when the crushing face moves away from the crushed bottle, the crushed bottle falls into a crushed bottle storage compartment.

In one embodiment, the crushed bottle storage compartment is located in the bottom of a trailer that can be pulled by a pick-up truck or similar vehicle. In an alternate embodiment, the propane bottle recycler is situated on top of a deck, and the crushed bottle storage compartment is located underneath the deck, directly beneath the bottle crusher tube of the bottle crusher.

Although the present invention is not limited to any particular number of bottle cradles, the bottle manifold preferably comprises ten bottle cradles. Furthermore, the bottle cradles are preferably sized to fit one-pound propane bottles.

The present invention optionally comprises an auxiliary port for draining propane bottles or tanks that do not fit in the bottle cradles.

REFERENCE NUMBERS

Figure 1:
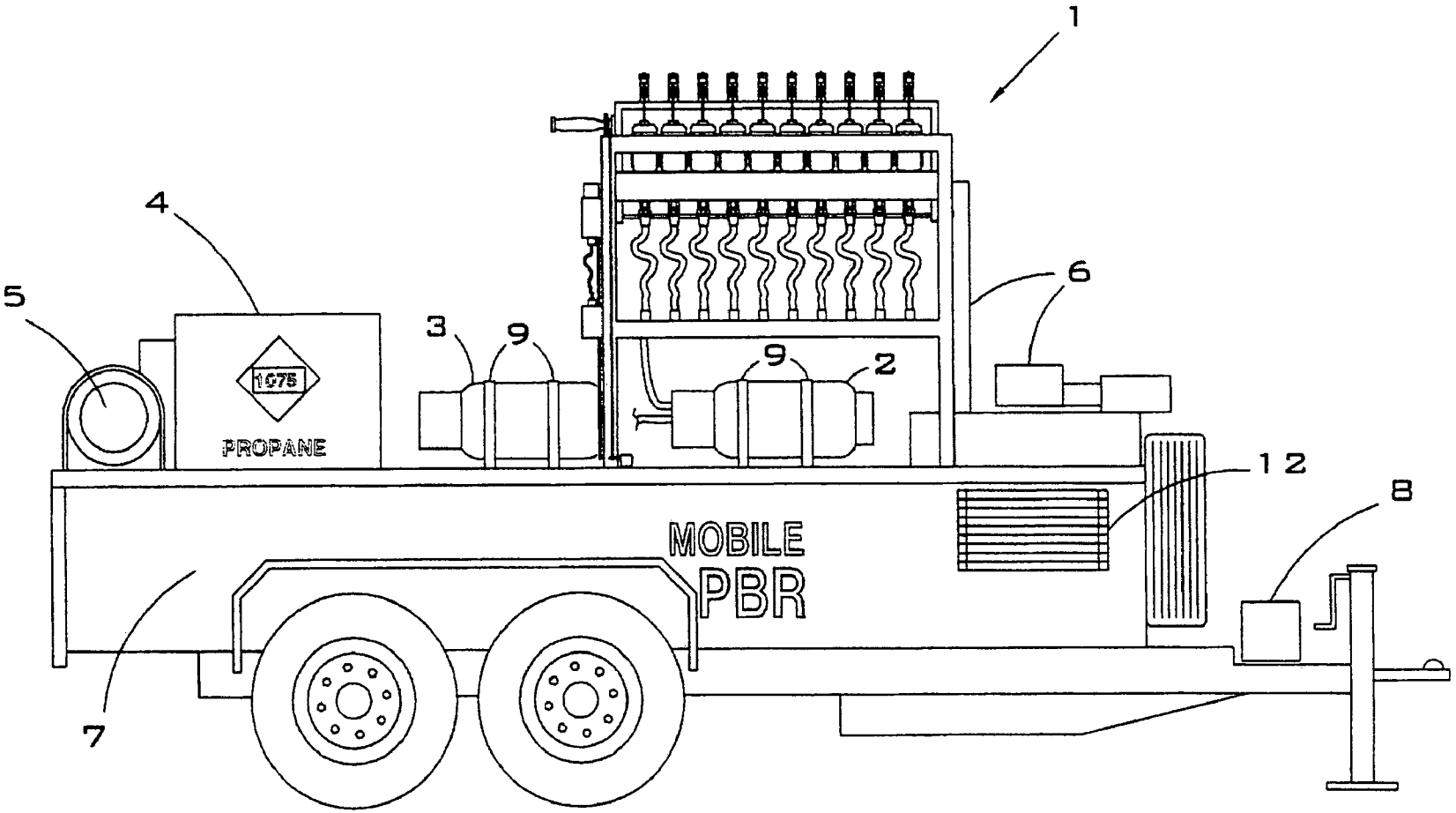
FIG. 1 is a side view of the present invention.

1 Bottle station
2 First propane collection tank
3 Second propane collection tank
4 Compressor box
5 Liquid propane storage tank
6 Bottle crusher
7 Crushed bottle storage compartment
8 Battery compartment
9 Quick-release saddle
10 Hoist
11 Propane-powered generator
12 Retractable stairs
13 Bottle manifold
14 Bottle station frame
15 Cam lever
16 Propane hose
17 Propane manifold
18 First main hose
19 Second main hose
20 Pressure/vacuum gauge (on propane manifold)
21 Propane bottles
22 Bolt (for holding bottle manifold in a vertical position)
23 Notch (in lever)
24 Lever (for holding bottle manifold in vertical position)
25 Handle
26 Foot pedal
27 Cable
28 Rod
29 Rubber stopper
30 Bottle cradle
31 Bottle header
32 Mouth (of propane bottle)
33 Female port (on propane bottle)
34 Receiving cavity (on bottle header)
35 Bolt (for pivoting bottle manifold)
36 Propane evacuation nipple
37 Solenoid valves
38 Electrical panel for solenoid valves
39 Switch
40 Portion of bottle manifold that triggers the switch
41 Knob (on switch)
42 Switch box (on bottle station)
43 Electrical box (for switch and solenoid valves)
44 Hose fittings
45 Bottle crusher tube
46 Hydraulic motor
47 Housing
48 Hydraulic cylinder
49 Sliding plate
50 Trailer floor
51 L-shaped extension
52 First switch
53 Second switch
54 Crushing area
55 Feed area
56 Lateral post
57 Crushing face
58 Spike
59 Backstop
60 Compressor motor
61 Compressor
62 Heat exchanger
63 Pressure gauge (on compressor)
64 Secondary seal
65 Edges (of bottle mouth)
66 Plunger
67 Outlet
68 O-ring retainer
69 O-ring
70 Propane outlet tube
71 Switch box (on bottle crusher)
72 Hydraulic ram
73 Connecting member
74 Spring-loaded plunger

DETAILED DESCRIPTION OF INVENTION

The present invention solves the problem of safely recycling used propane bottles in mass quantities so that both the propane and the steel that is used to make the bottles can be recycled. The present invention is a propane bottle recycler that is built onto a trailer or deck. If built onto a trailer, the trailer can be hauled into a collection site, and the bottles can be collected and recycled onsite. If built onto a deck, the propane bottle recycler unit would be stationary. The present invention covers both a mobile and a stationary embodiment of the propane bottle recycler. FIGS. 1-5 show the propane bottle recycler on top of a trailer. In the stationary embodiment, instead of the propane bottle recycler being positioned on top of the trailer floor, it would be positioned on top of a deck, and the crushed bottle storage compartment would be located underneath the deck, directly beneath the bottle crusher tube of the bottle crusher.

FIG. 1 is a side view of the present invention. This figure shows the bottle station 1, a first propane collection tank 2, a second propane collection tank 3, the compressor box 4, and the liquid propane storage tank 5. The bottle crusher 6 and crushed bottle storage compartment 7 are also shown. A battery compartment 8 in the front of the trailer houses the battery that runs the hydraulics for the trailer lift bed and the hoist (shown in FIG. 3).

In the present invention, up to ten bottles at a time are loaded onto the bottle station, which is discussed in greater detail in connection with FIGS. 6-15. The propane is emptied from the bottles through a compressor pump (which creates a vacuum) into a first propane collection tank 2 and then a second propane collection tank 3. The second propane collection tank is optional, but the inventors have determined that it is preferable in order to provide greater time for the propane to vaporize. The inventors have found that it is more effective to move the propane in a vaporized form than in a liquid form, mainly because vapor pumps/compressors can run dry for periods of time, whereas liquid pumps cannot.

The vaporized propane is then repressurized by the compressor (which is located inside the compressor box 4) and stored in liquid form in a propane storage tank 5. The reason the propane is reliquefied is because more propane can be stored in liquid form than in a gaseous state. All three tanks—the first and second propane collection tanks and the liquid propane storage tank—are held in place on the trailer with quick-release saddles 9. The liquid propane storage tank 5 includes a gauge (not shown) that tells the operator when the tank is full so that the tank can be replaced. There is also a one-way valve (not shown) on the outside of the liquid propane storage tank 5 that prevents the liquid propane from seeping back toward the compressor.

As discussed more fully below, the present invention is self-powered and can run on the propane that is recovered from the recycled bottles. After the propane is recovered from the bottles, the bottles are removed and placed into the bottle crusher 6. A pressure/vacuum gauge 20 (shown in FIG. 6) is used to indicate when all of the propane in the bottles has been recovered so that the operator knows when he can safely remove the bottles and place them into the bottle crusher. As discussed more fully below in connection with FIGS. 16-18, the bottle crusher 6 punctures and crushes the bottles. The bottles are delivered from the bottle crusher 6 into the crushed bottle storage compartment 7. The trailer version of the bottle storage compartment can hold approximately 3000 crushed bottles.

Figure 2:
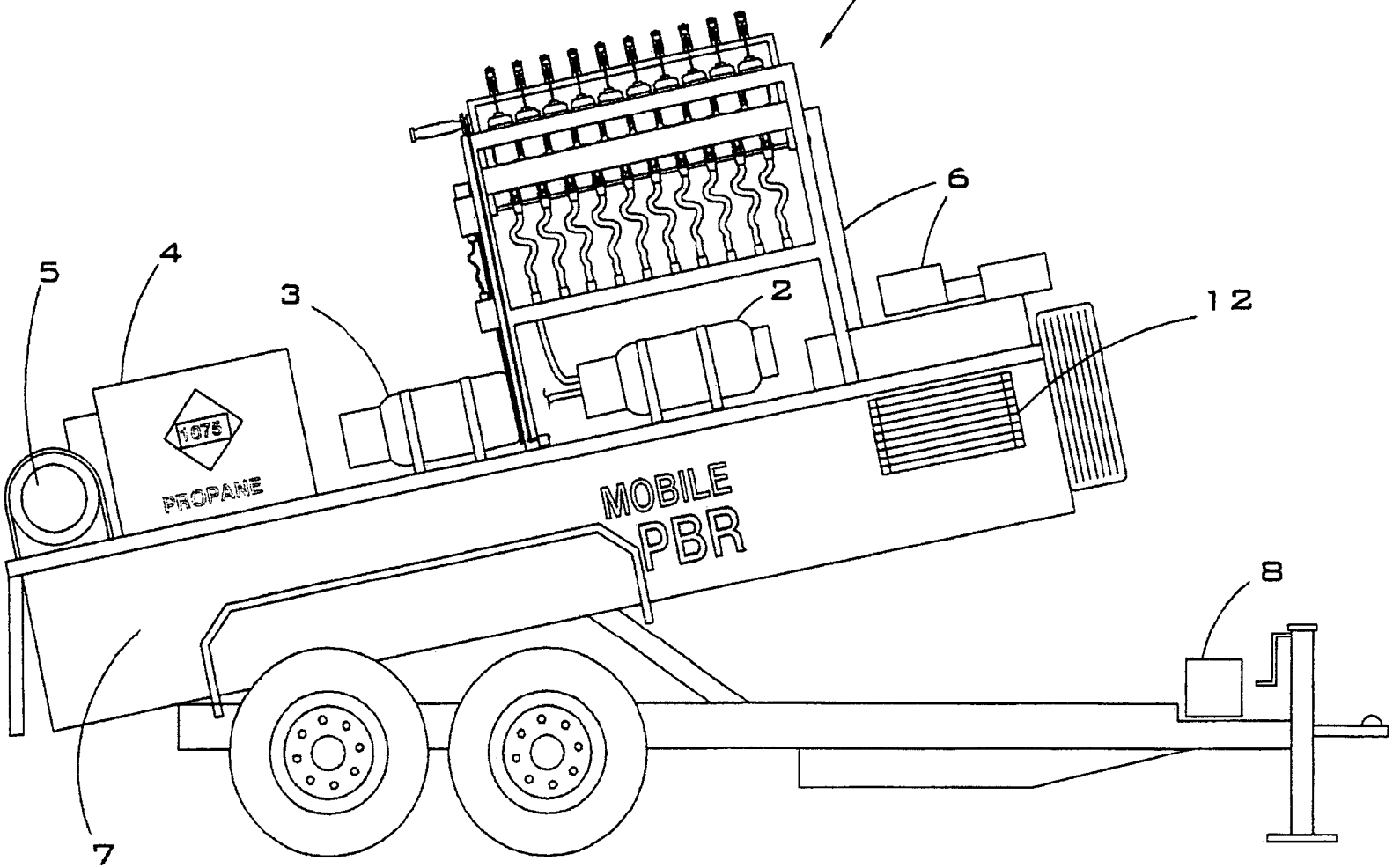
FIG. 2 is a side view of the present invention with the front end of the trailer tilted upward.

FIG. 2 is the same as FIG. 1, except that the front end of the trailer is tilted upward (using hydraulics, as is known in the art) so that the crushed bottles in the storage compartment 7 can be emptied through the back end of the trailer. The emptied and crushed propane bottles are considered prepared scrap steel, which provides the highest value to recyclers. In the stationary version of the propane bottle recycler, the crushed bottle storage compartment would simply be removed from underneath the deck and emptied.

Figure 3:
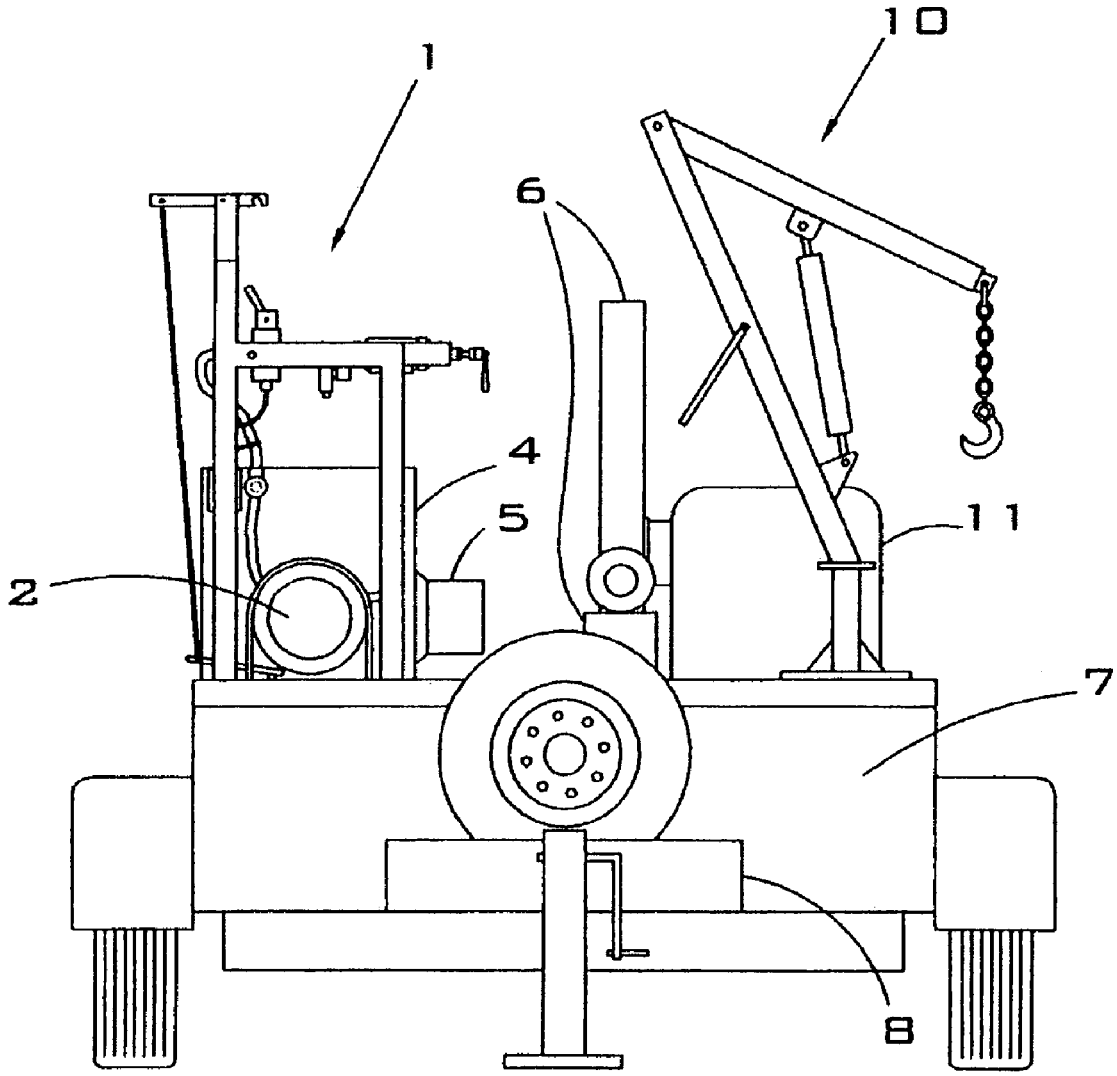
FIG. 3 is a front view of the present invention.

FIG. 3 is a front view of the present invention. This figure shows the bottle station 1, the first propane collection tank 1, the compressor box 4, the liquid propane storage tank 5, the bottle crusher 6, and the crushed bottle storage compartment 7. It also shows the optional hoist 10 that is used to lift containers or receptacles of used propane bottles up onto the trailer. In addition, this figure shows the propane-powered generator 11 that is used to run the compressor motor, the hydraulic pump for the bottle crusher, and the solenoid valves for the bottle station. Liquid propane may be allowed to flow through a hose to a regulator and then to the generator 11 from the liquid propane storage tank 5. If propane is generated beyond that which is needed to run the propane bottle recycler, the excess propane can be transferred into larger, refillable propane tanks for use in heating homes or for running propane-powered equipment.

Figure 4:
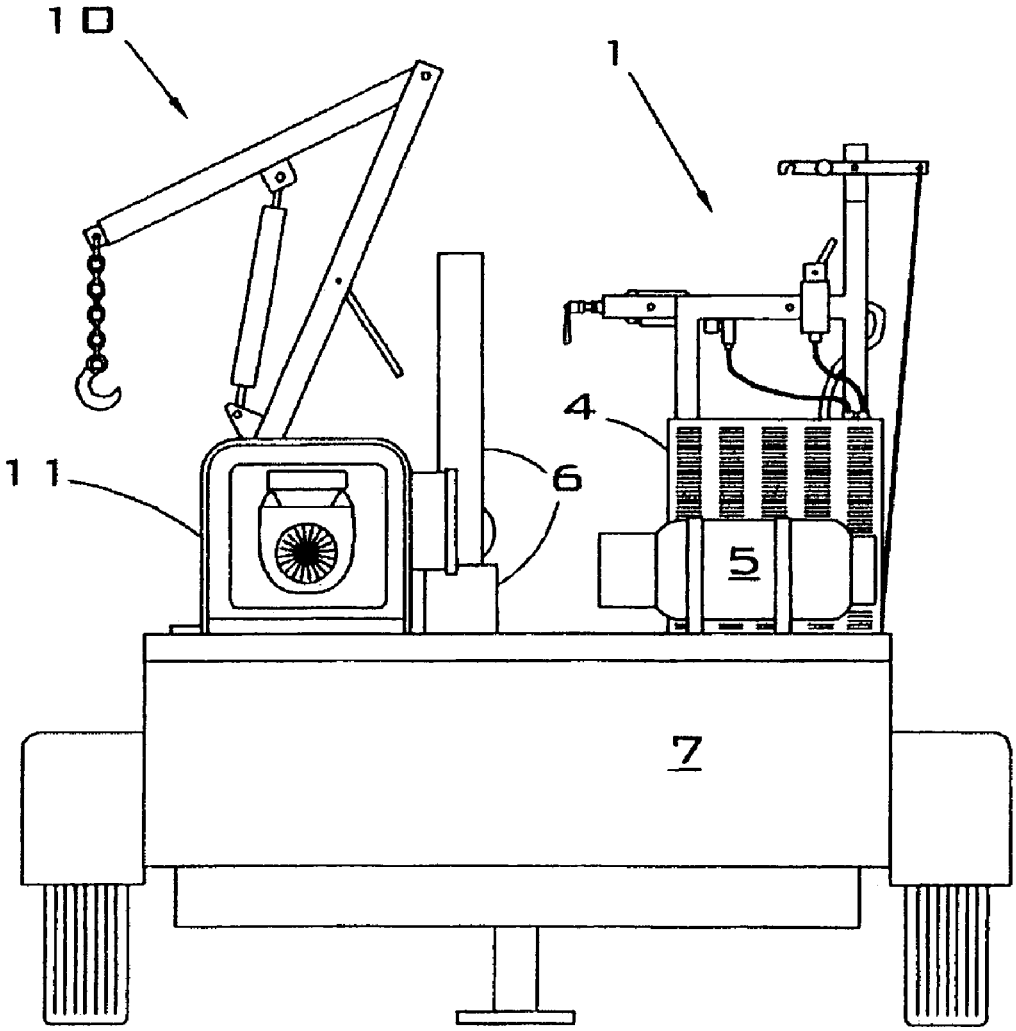
FIG. 4 is a back view of the present invention.

FIG. 4 is a back view of the present invention. This figure shows the bottle station 1, compressor box 4, liquid propane storage tank 5, bottle crusher 6, crushed bottle storage compartment 7, hoist 10, and propane-powered generator 11.

Figure 5:
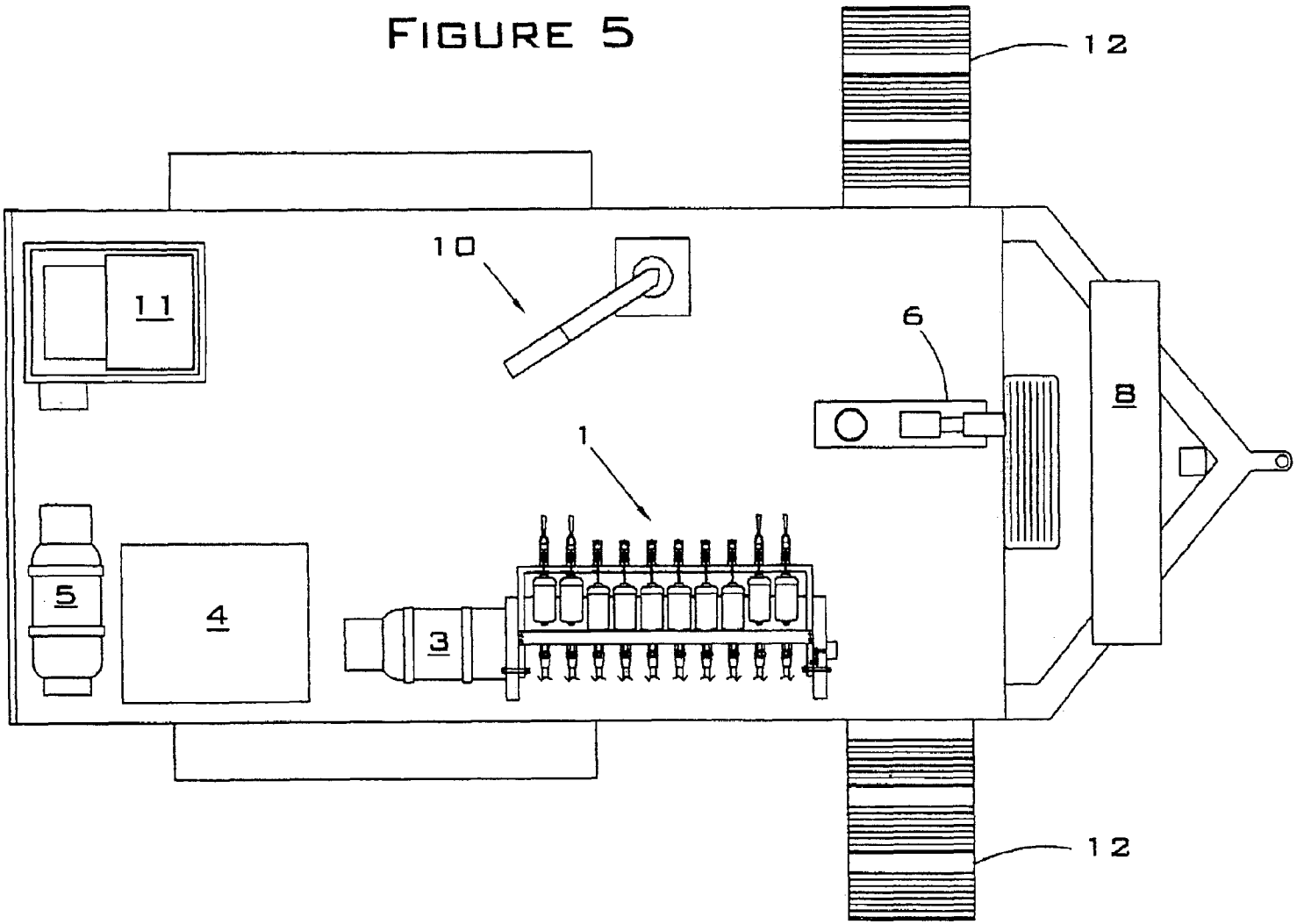
FIG. 5 is a top view of the present invention.

FIG. 5 is a top view of the present invention. This figure shows the bottle station 1, the second propane collection tank 3 (the first propane collection tank is omitted for clarity purposes), the compressor box 4, the liquid propane storage tank 5, the bottle crusher 6, the hoist 10, and the propane-powered generator 11. It also shows the retractable stairs 12 on either side of the trailer.

Figure 6:
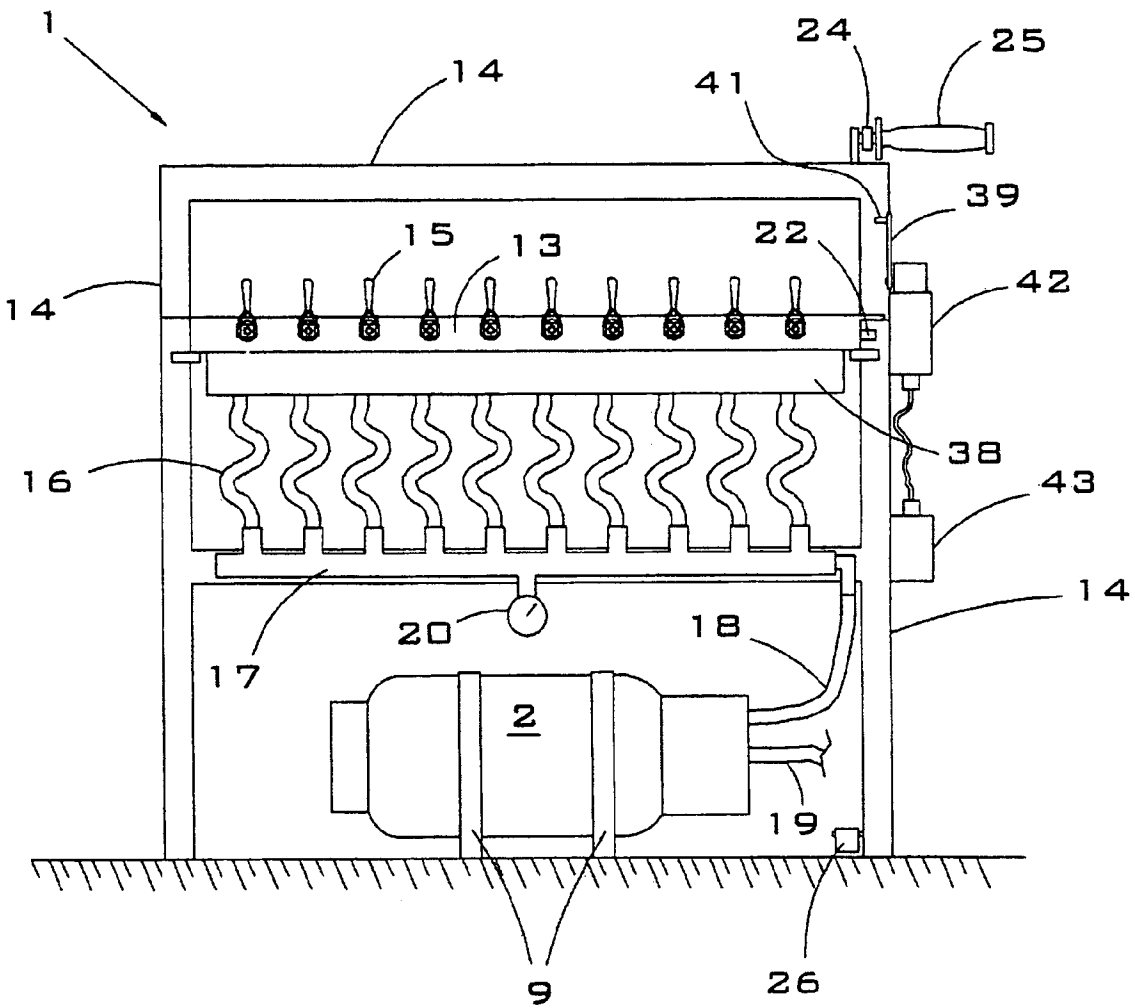
FIG. 6 is a front view of the bottle station without any bottles and with the bottle manifold in a horizontal position.
Figure 12:
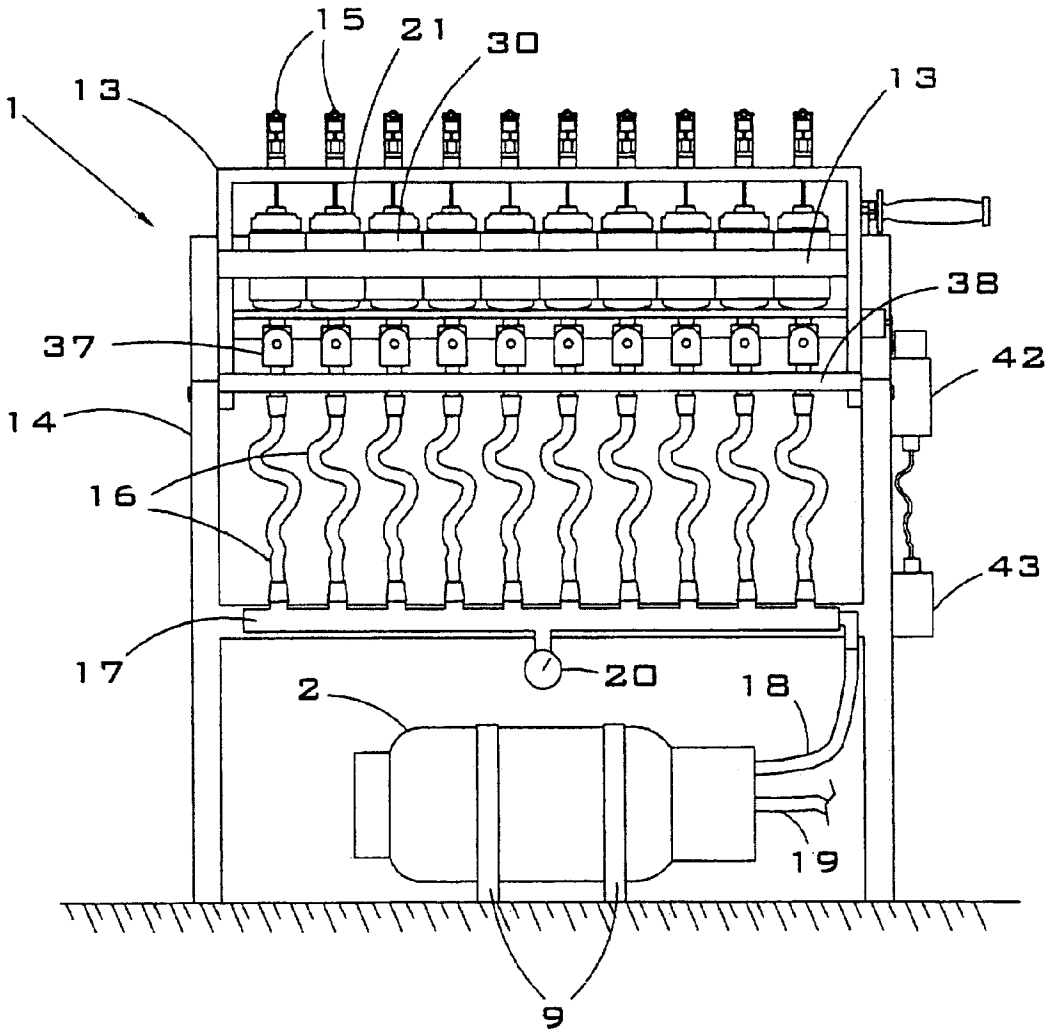
FIG. 12 is a front view of the bottle station with bottles and with the bottle manifold in a vertical position.

FIG. 6 is a front view of the bottle station without any bottles and with the bottle manifold in a horizontal position. This figure shows the bottle manifold 13, which holds up to ten one-pound propane bottles, and which can alternate between a horizontal and vertical position. There are bolts (not shown) on either side of the bottle manifold 13 that pivotally attach the bottle manifold 13 to the bottle station frame 14. The bottles are inserted into the bottle manifold 13 (shown more clearly from the top view of FIG. 10) and held in place by cam levers 15. When the bottle manifold 13 is raised to a vertical position (as shown in FIG. 12) and the solenoid valves (also shown in FIG. 12) are opened, the propane from the bottles flows into the propane hoses 16. The propane hoses 16 collect the propane in the propane manifold 17.

Due to the vacuum created by the compressor (not shown), the propane travels from the propane manifold 17 via a first main hose 18 into the first propane collection tank 2. From there, the propane travels via a second main hose 19 into a second propane collection tank 3 (not shown). The pressure/vacuum gauge 20 on the propane manifold 17 tells the operator when the propane has been removed from the bottles (because the pressure drops to zero). Although the pressure/vacuum gauge 20 is shown in this figure as extending from the bottom of the propane manifold 17, the present invention is not limited to any particular location of the pressure/vacuum gauge.

Figure 7:
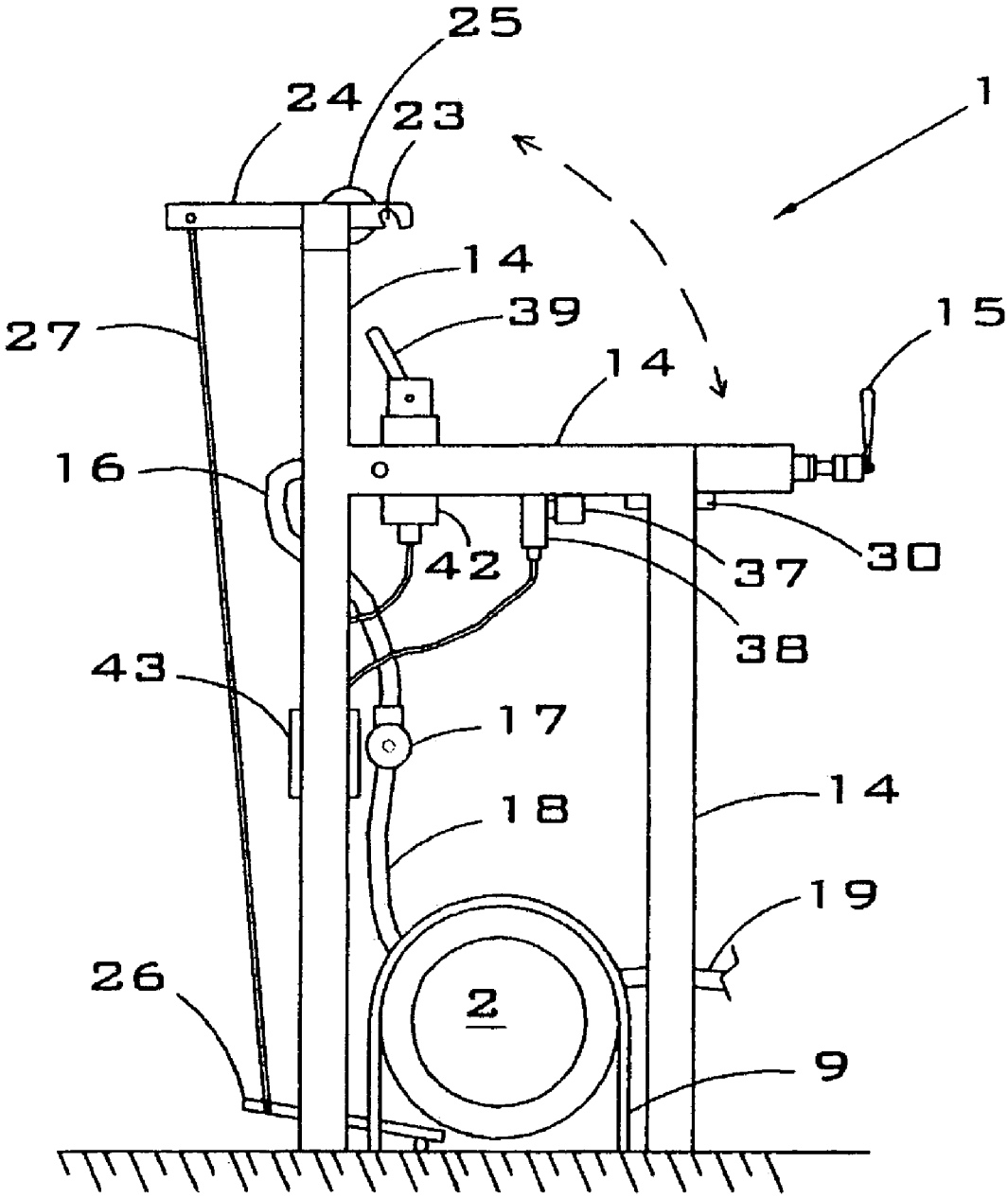
FIG. 7 is a side view of the bottle station without any bottles and with the bottle manifold in a horizontal position.

FIG. 7 is a side view of the bottle station without any bottles and with the bottle manifold in a horizontal position. This figure shows the bottle station frame 14, the cam levers 15 (only one is visible due to the fact that this is a side view), the propane hoses 16 (again, only one is visible, but there are ten propane hoses), the propane manifold 17, the first main hose 18 leading to the first propane collection tank 2, and the second hose 19 leading to the second propane collection tank 3 (not shown).

Figure 8:
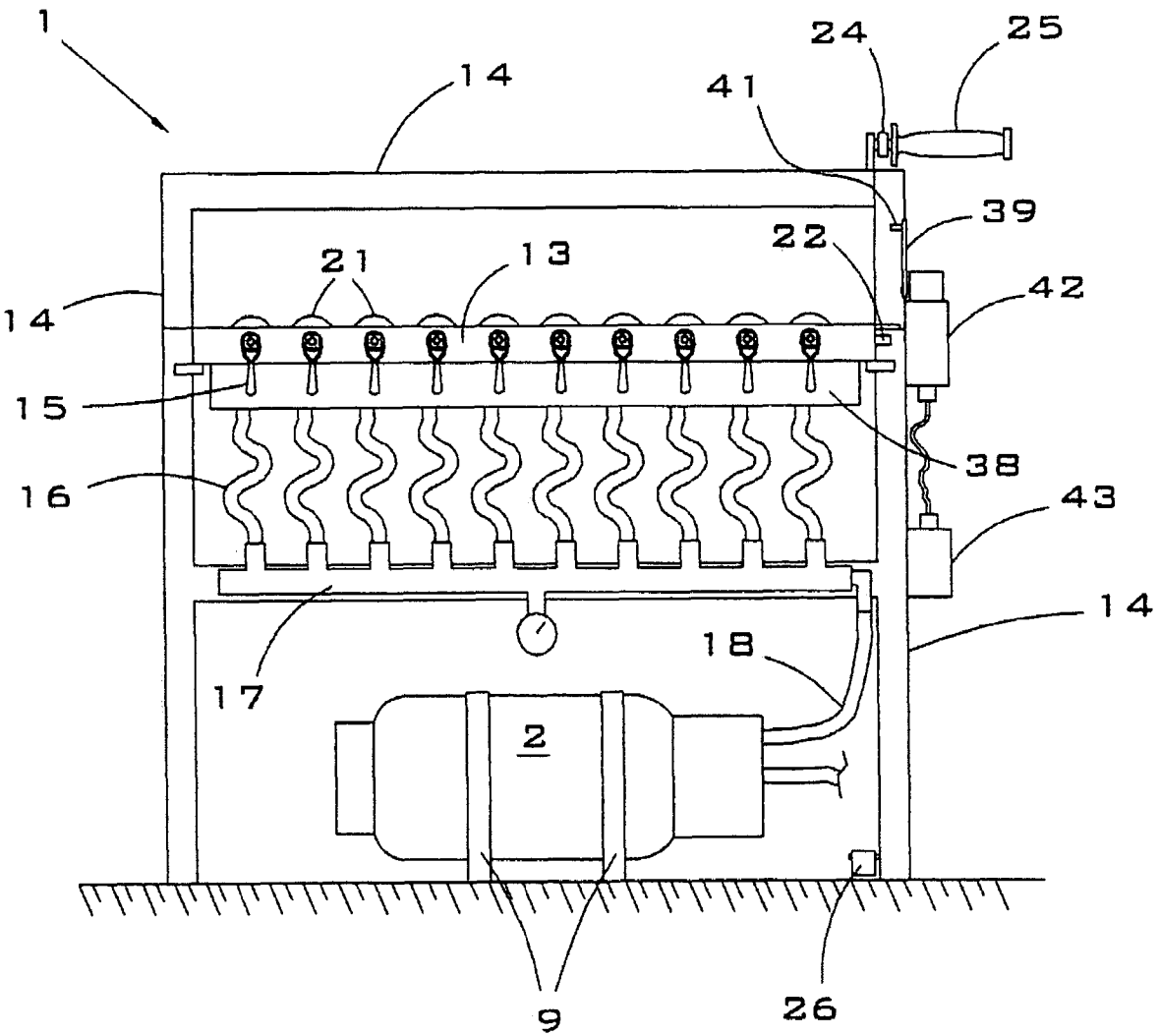
FIG. 8 is a front view of the bottle station with bottles and with the bottle manifold in a horizontal position.

FIG. 8 is a front view of the bottle station with bottles and with the bottle manifold in a horizontal position. This figure is the same as FIG. 6, except that the propane bottles 21 have been inserted into the bottle manifold 13. When the bottle manifold 13 is tiled to a vertical position, a bolt 22 on the side of the bottle manifold 13 fits into a notch 23 (shown in FIGS. 7 and 9) on a lever 24 that is attached to the top of the right-hand side of the bottle station frame 14, thereby holding the bottle manifold 13 securely in a vertical position. The lever 24 can be released either manually by using the handle 25 shown in FIG. 6, or by using the foot pedal 26 shown in FIG. 7. A cable 27 (shown in FIGS. 7 and 9) connects the lever 24 to the foot pedal 26.

Figure 9:
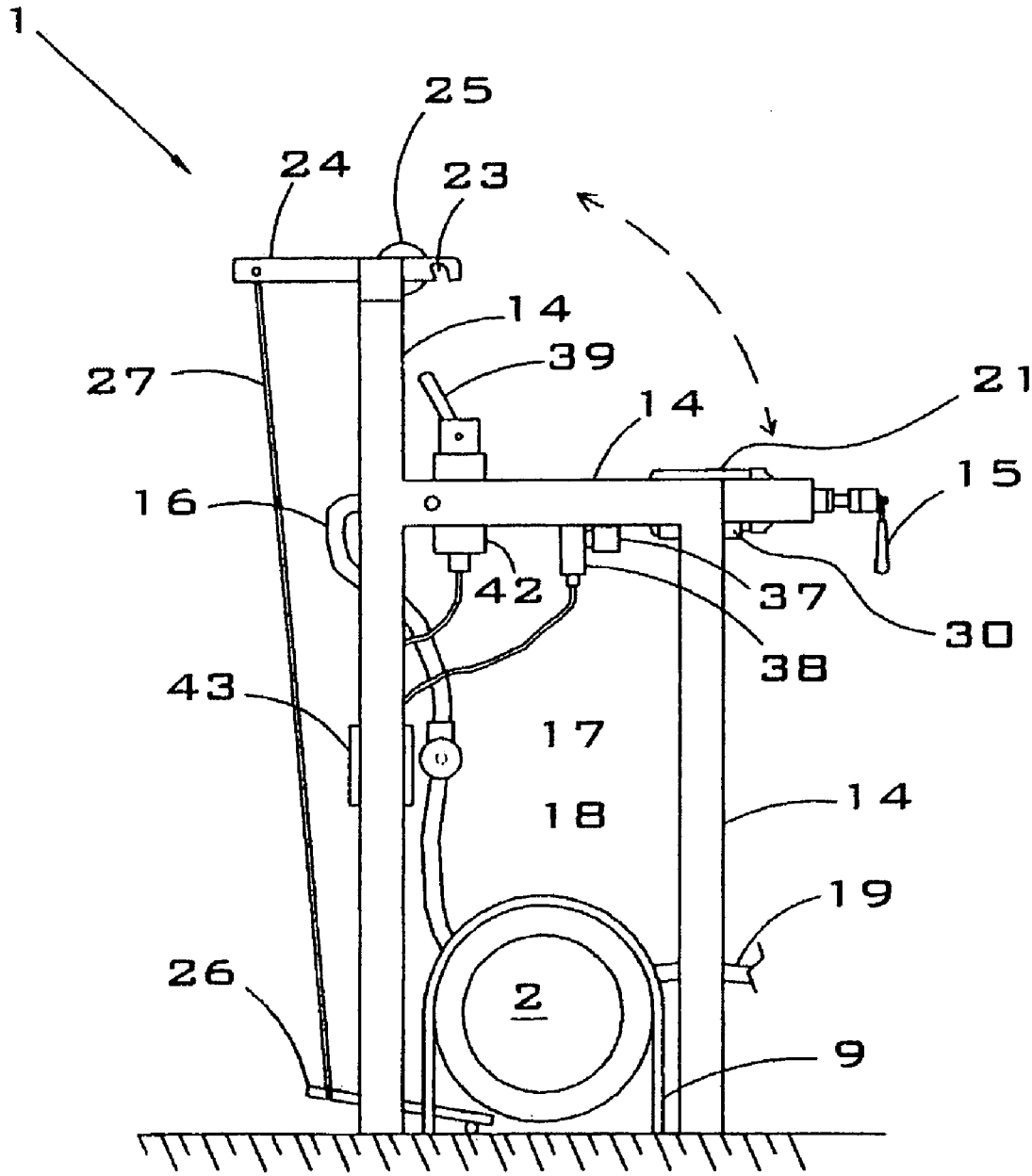
FIG. 9 is a side view of the bottle station with bottles and with the bottle manifold in a horizontal position.
Figure 9A:
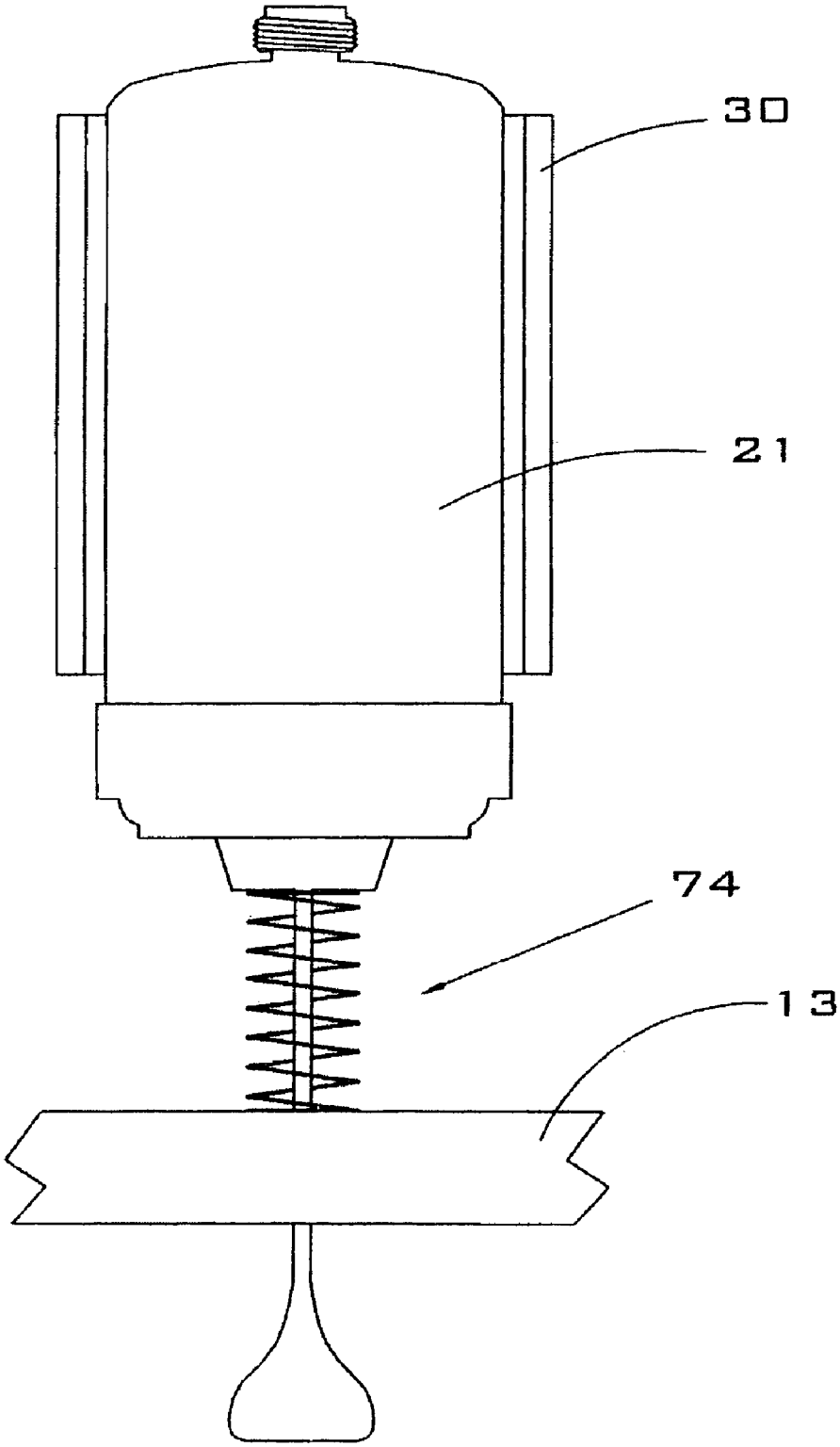
FIG. 9A is a top view of a spring-loaded plunger.

FIG. 9 is a side view of the bottle station with bottles and with the bottle manifold in a horizontal position. This figure is the same as FIG. 7, except that the propane bottles 21 have been inserted into the bottle manifold 13. As shown more clearly in FIG. 10, when the cam levers 15 are in a horizontal position, the bottles can be inserted into or removed from the bottle manifold 13. When the cam levers are in a vertical position (either up or down), the bottles 21 are held securely within the bottle manifold 13 and cannot be removed. Although the figures are shown with cam levers, the present invention is not limited to any particular means for holding the bottles in place in the bottle station. For example, spring-loaded plungers (see FIG. 9A) could be used in lieu of the cam levers.

Figure 10:
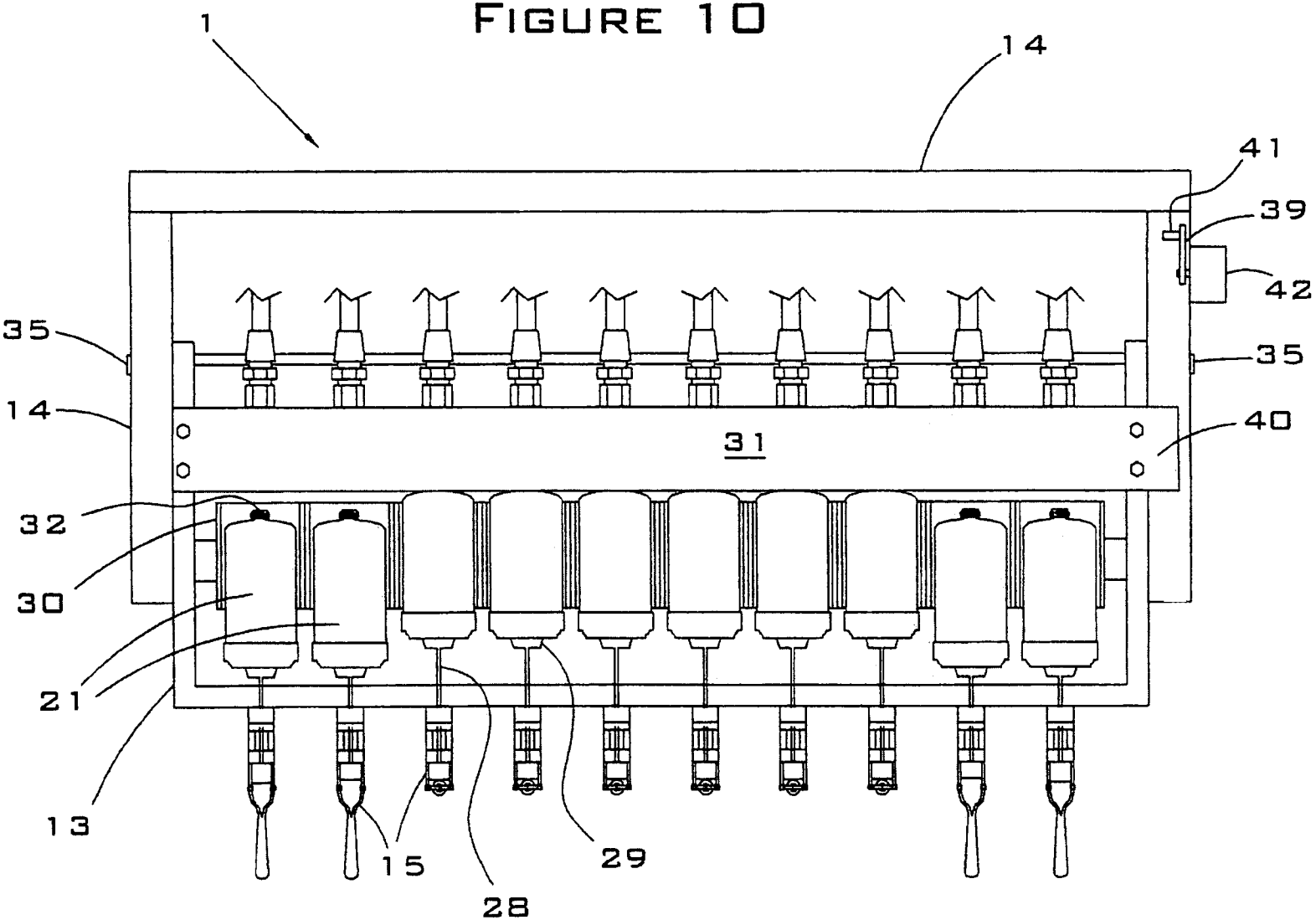
FIG. 10 is a top view of the bottle station with bottles and with the bottle manifold in a horizontal position.

FIG. 10 is a top view of the bottle station with bottles and with the bottle manifold in a horizontal position. As shown in this figure, each of the cam levers 15 comprises a rod 28 and a rubber stopper 29. When the cam lever 15 is in a vertical position, the rod 28 is fully extended, and the rubber stopper 29 is flush up against the bottom of the propane bottle 21. The pressure of the rubber stopper 29 against the bottom of the propane bottle 21 holds the bottle in place. Each bottle 21 rests in a bottle cradle 30 in the bottle manifold 13. The present invention is not limited to any particular number of bottle cradles, but the preferred embodiment comprises ten cradles 30. The cradles are sized to fit standard one-pound propane bottles.

The bottle manifold 13 comprises a bottle header 31, into which the tops of the propane bottles 21 are inserted. The top of each propane bottle 21 comprises a mouth 32 through which the propane is drained. Inside the mouth 32 of each propane bottle 21 is a female port 33 (shown in FIG. 11). The female port 33 fits into a receiving cavity 34 (also shown in FIG. 11) in the bottle header 31. Both the female port 33 on the bottle and the receiving cavity 34 on the bottle header are sealed so that when the bottle is inserted into the bottle header and locked into placed by the cam lever, no propane liquid or gas will escape into the atmosphere (see FIG. 11). The system is entirely sealed from this point (the point of bottle insertion) to the liquid propane storage tank 5. The bolt 35 that allows the bottle manifold 13 to pivot on the bottle frame 14 is also shown in FIG. 10.

Figure 11:
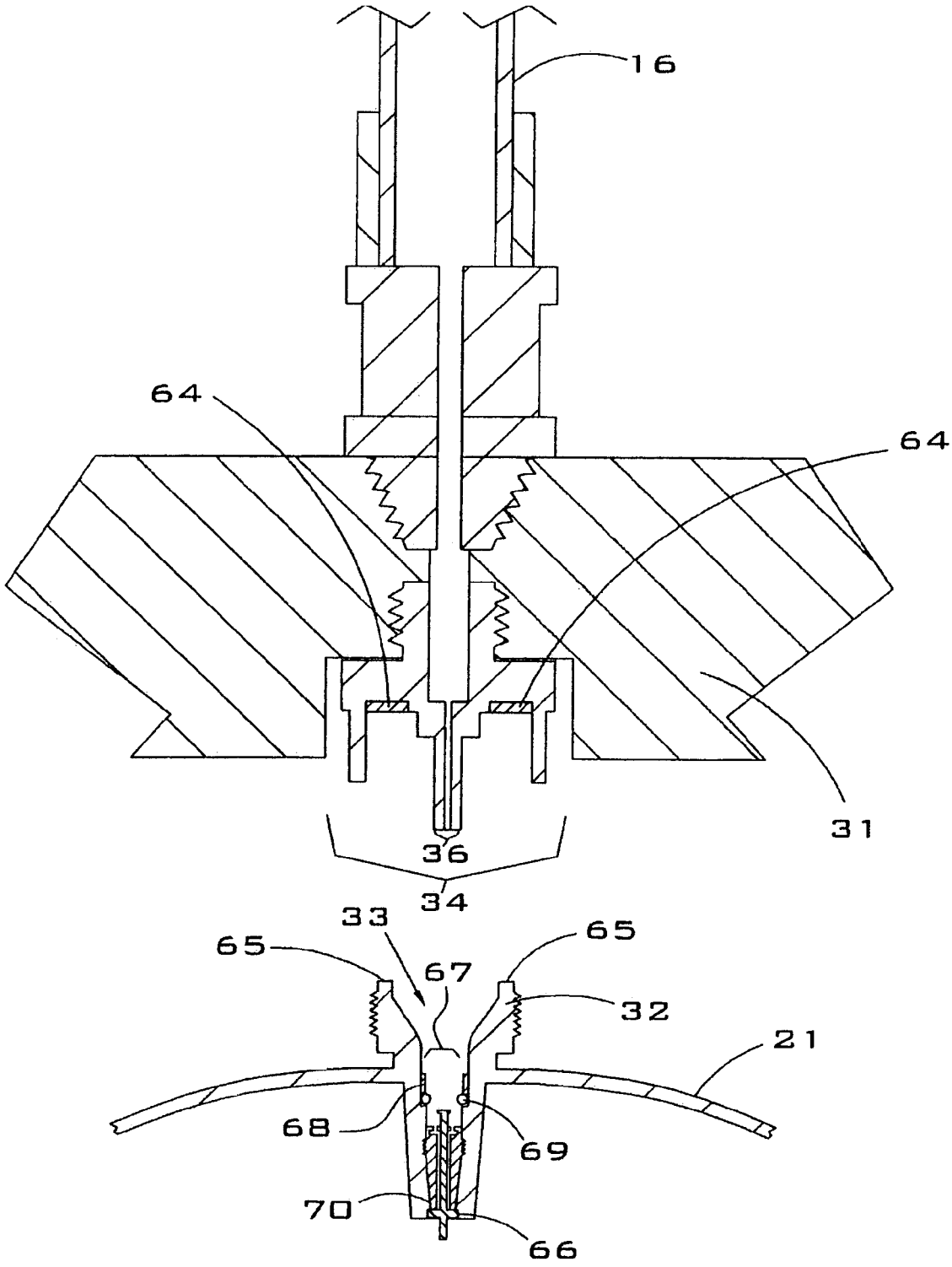
FIG. 11 is a section view of the female port of the propane bottle mouth and the male port on the bottle header.

FIG. 11 is a section view of the female port 33 of the propane bottle mouth 32 and the receiving cavity 34 on the bottle header 31. Although the mouths 32 of propane bottles are typically threaded (as shown here), the sides of the receiving cavity 34 are not threaded, which allows for quick and easy bottle insertion.

As shown in FIG. 11, each receiving cavity 34 on the bottle header 31 comprises a propane evacuation nipple 36 and a secondary seal 64. When the mouth 32 of the propane bottle is inserted into the receiving cavity 34, the edges 65 of the mouth 32 come into contact with the secondary seal 64, and the propane evacuation nipple 36 presses down on a plunger 66 inside the mouth of the propane bottle. The plunger 66 is spring-loaded so that it remains in an upward position until and unless it is pushed downward by the propane evacuation nipple 36. When the plunger 66 is pushed downward, propane enters the propane outlet tube 70 and escapes through the outlet 67 and into the propane evacuation nipple 36, which leads to the propane hose 16. The O-ring 69 and O-ring retainer 68 seal the propane evacuation nipple when it is inserted into the outlet 67.

FIG. 12 is a front view of the bottle station with bottles and with the bottle manifold in a vertical position. In addition to showing the propane bottles 21, bottle cradles 30, bottle manifold 13 and bottle station frame 14, this figure shows the solenoid valves 37, which, when opened, allow the propane to flow from the propane bottles 21 into the propane hoses 16. An electrical panel 38 carries power to the solenoid valves, which are controlled by a switch 39 (see FIG. 1). The switch 39 is triggered when the bottle manifold 13 is raised to a vertical position. When that happens, a portion 40 (see FIG. 10) of the bottle manifold engages with a knob 41 on the switch, and the switch is moved into an "open" or "on" position. With the switch in an "on" position, the solenoid valves are opened, and propane is allowed to flow out of the tops of the propane bottles 21 (which are now inverted) and into the propane hoses 16. A switch box 42 controls the switch, and the switch box receives its power from an electrical box 43 directly beneath it. The electrical box 43 supplies electricity to the switch box 42 and to the electrical panel 38 for the solenoid valves.

In an alternate embodiment, not shown in the figures, the bottle station comprises only one solenoid valve, which is located between the propane manifold 17 and the first main hose 18. The one solenoid valve controls the flow of propane from the propane manifold 17 to the first propane collection tank 2. In lieu of the ten solenoid valves 37 shown in FIG. 12, there are ten one-way valves, which allow propane to flow out of the bottles 21, through the propane hoses 16 and into the propane manifold 17. The propane will not flow into the first propane collection tank 2 unless the single solenoid valve is open.

Figure 13:
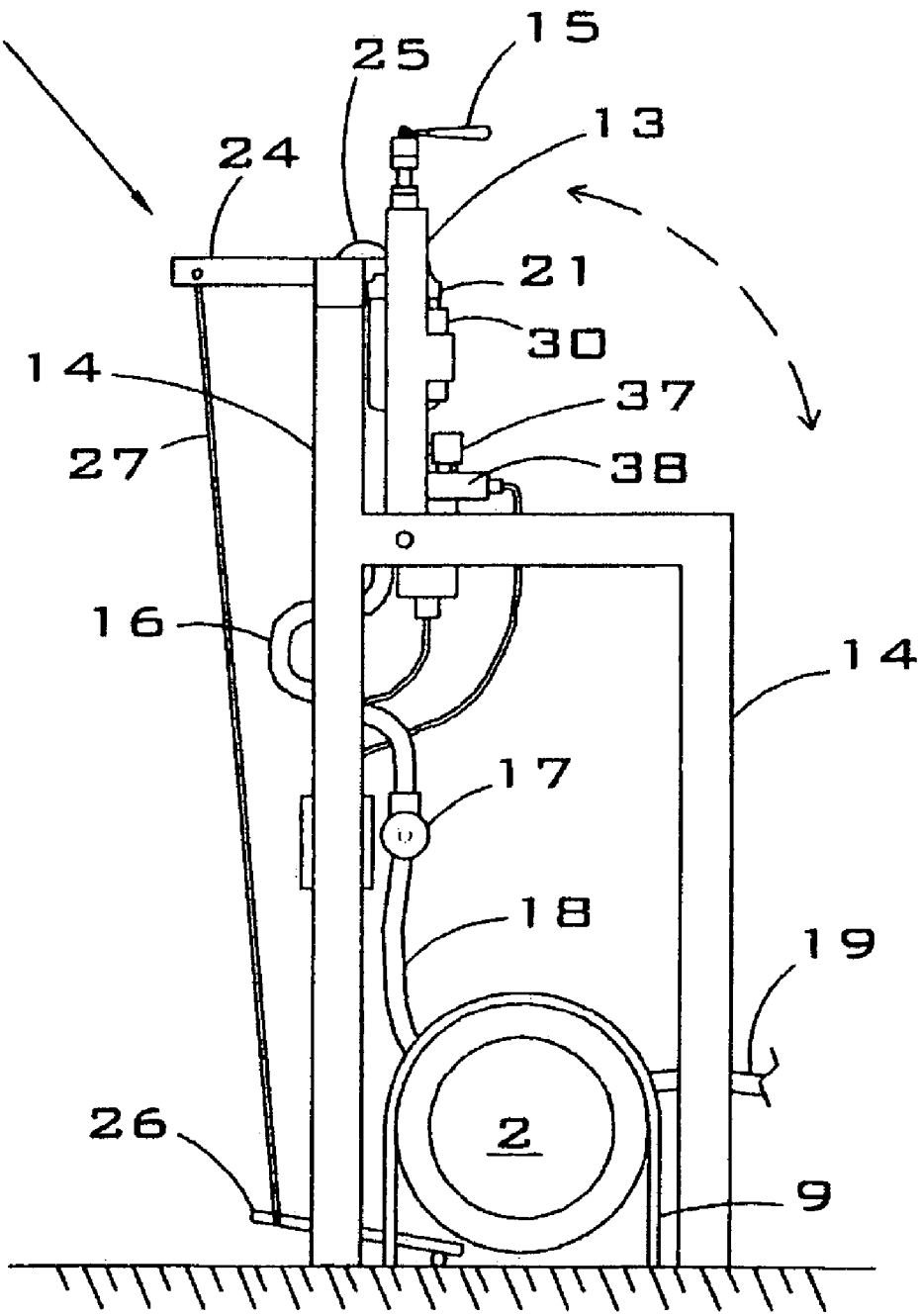
FIG. 13 is a side view of the bottle station with bottles and with the bottle manifold in a vertical position.

FIG. 13 is a side view of the bottle station with bottles and with the bottle manifold in a vertical position. When the bottles 21 are in a vertical position and the solenoid valves 37 are open, the propane flows freely (both due to gravity and due to the vacuum in the system created by the compressor) out of the bottles and into the propane hoses.

Figure 14:
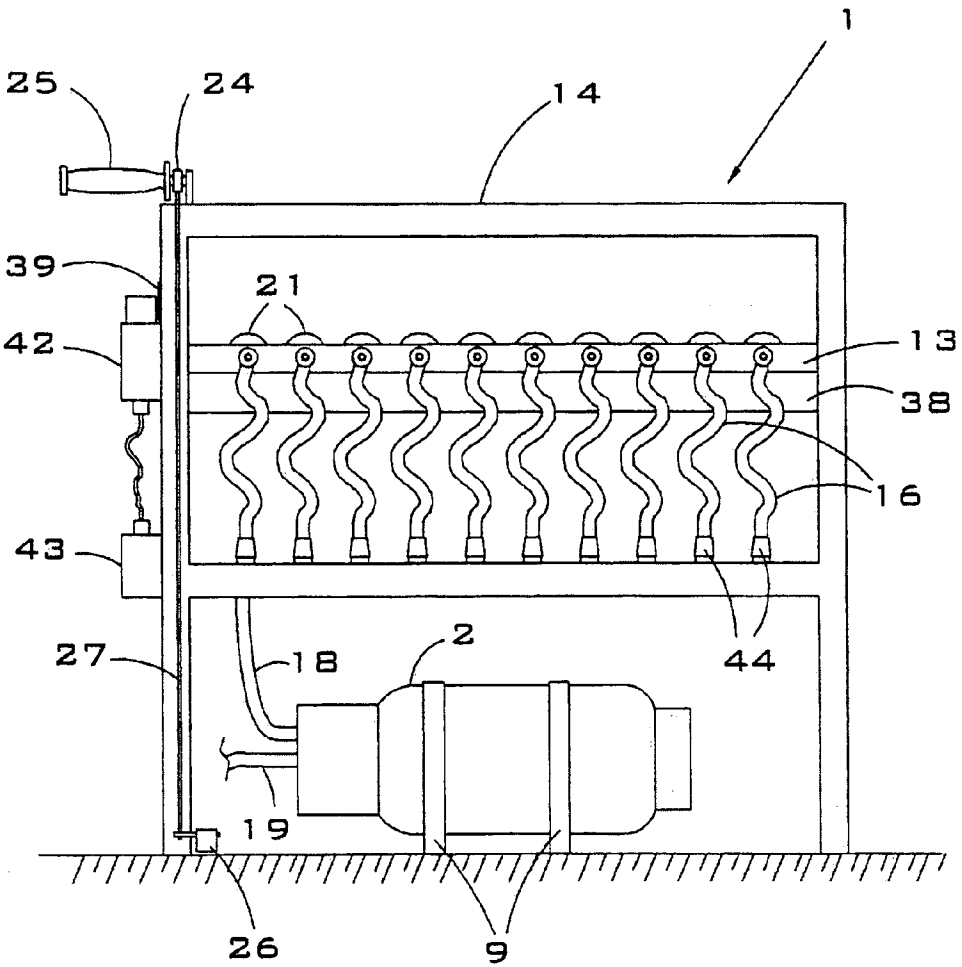
FIG. 14 is a back view of the bottle station with bottles and with the bottle manifold in a horizontal position.
Figure 15:
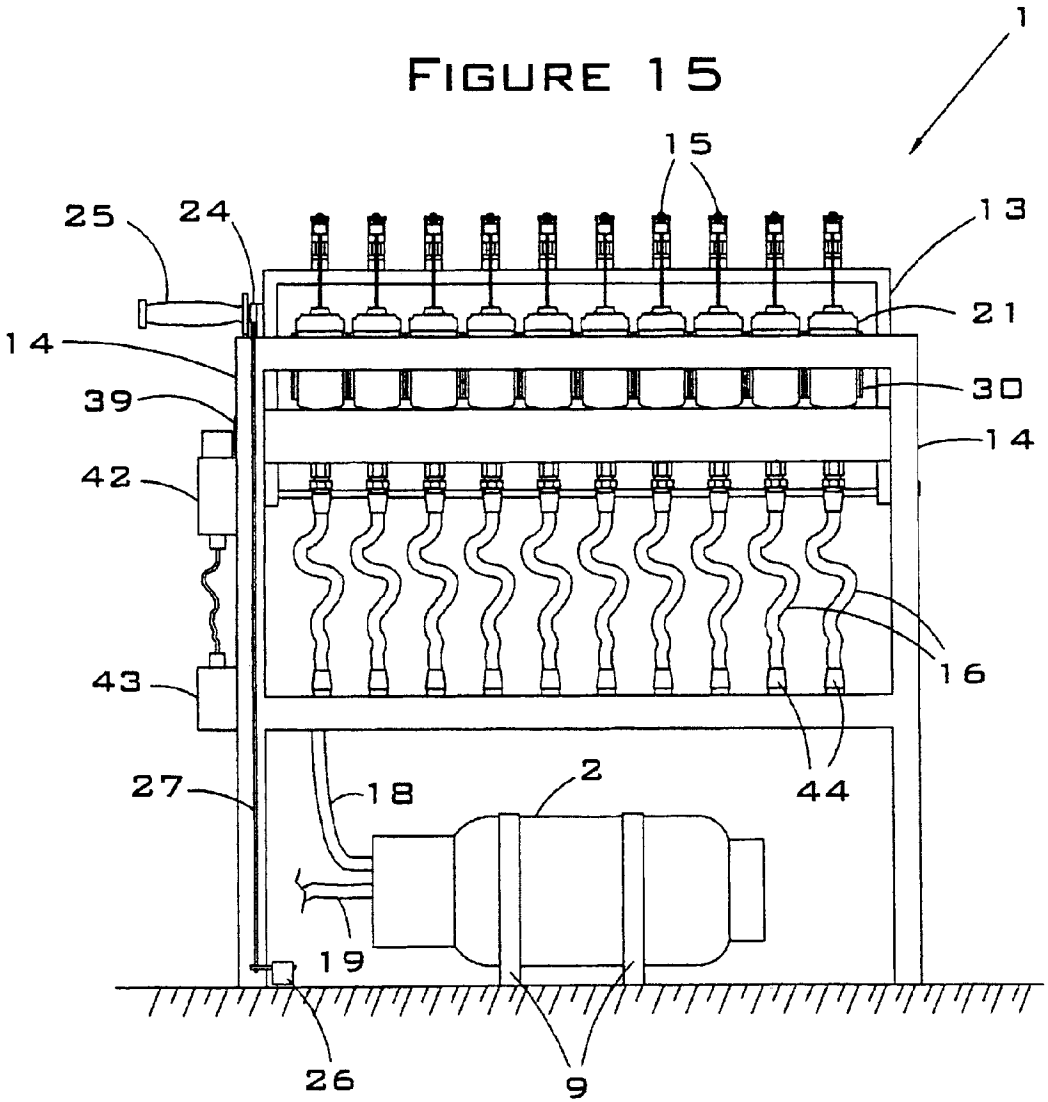
FIG. 15 is a back view of the bottle station with bottles and with the bottle manifold in a vertical position.

FIG. 14 is a back view of the bottle station with bottles and with the bottle manifold in a horizontal position. As shown in this figure, hose fittings 44 connect the propane hoses 16 to the propane manifold 17 (not shown). FIG. 15 is a back view of the bottle station with bottles and with the bottle manifold in a vertical position.

In an alternate embodiment (not shown), the bottle station would not pivot from horizontal to vertical but instead would be permanently in a vertical position. The inventors believe this particular configuration would not be preferable, however, because it would be more difficult to load the bottles. In the vertical-only configuration, the solenoid valve or valves would not be triggered by the raising of the bottle station to a vertical position; instead, the solenoid valves would have to be triggered by a manual switch.

Figure 16:
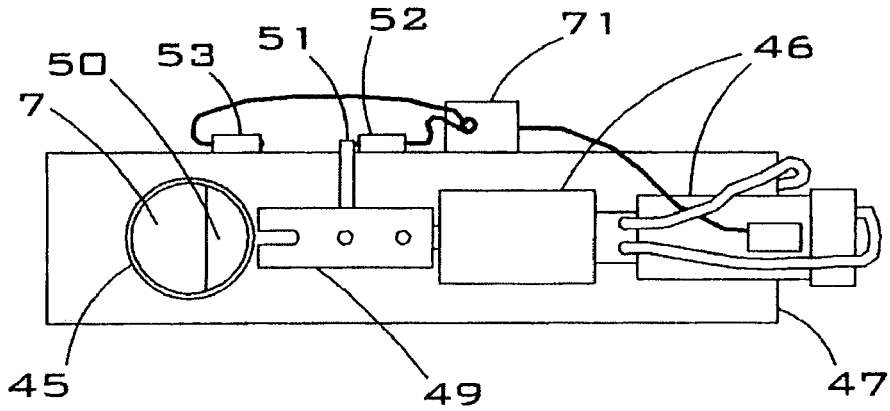
FIG. 16 is a top view of the bottle crusher without any bottles and with the sliding plate in an open position.
Figure 17:
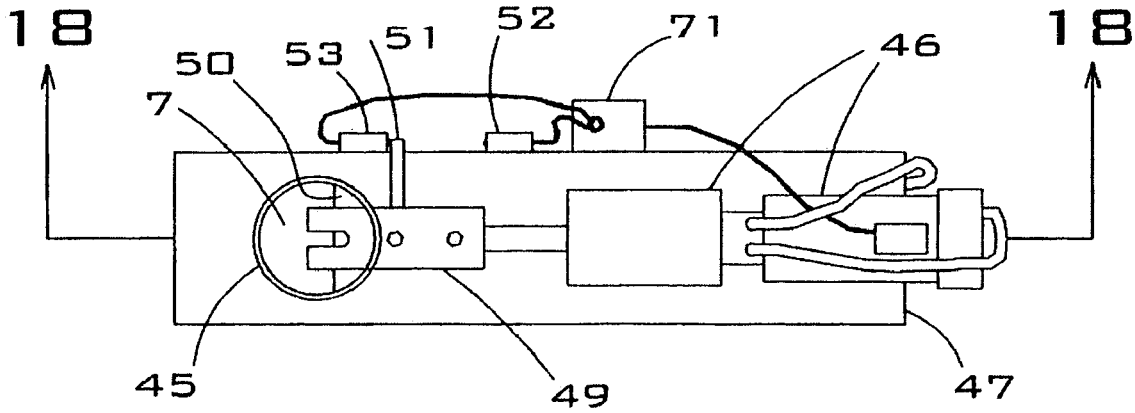
FIG. 17 is a top view of the bottle crusher without any bottles and with the sliding plate in a closed position.

FIG. 16 is a top view of the bottle crusher without any bottles and with the sliding plate in an open position. Bottles that have been emptied as described above are placed in the bottle crusher tube 45. The bottle crusher 6 is powered by a hydraulic motor 46, which sits on top of the housing 47 for the hydraulic cylinder 48 (shown in FIG. 18). The hydraulic cylinder causes the sliding plate 49 to move backward and forward. In FIG. 16, the sliding plate 49 is all the way backward (or in an open position). As shown more clearly in FIG. 18, when the sliding plate 49 is in an open position, the bottle that has just been crushed falls through the trailer floor 50 into the crushed bottle storage compartment 7, and the next bottle falls down into position to be punctured and crushed. When the sliding plate 49 is in a closed position (or all the way forward, as shown in FIG. 17), it prevents the next bottle from moving downward. The bottle directly beneath the sliding plate 49 is the bottle that is being punctured and crushed.

The sliding plate 49 comprises an L-shaped extension 51 that is perpendicular to the sliding plate and that extends down and around the side of the housing 47. This extension trips a first switch 52 when the sliding plate is in a fully open position and causes the sliding plate to begin moving in the opposite direction. In FIG. 16, the L-shaped extension 51 is shown in contact with the first switch. The extension trips a second switch 53 when the sliding plate is in a fully closed (or forward) position, which causes the sliding plate to being moving in the opposite direction (back toward the first switch). In FIG. 17, the L-shaped extension 51 is shown in contact with the second switch. In operation, the sliding plate 49 moves continuously from one position to another. A switch box 71 controls the operation of the switches.

Figure 18:
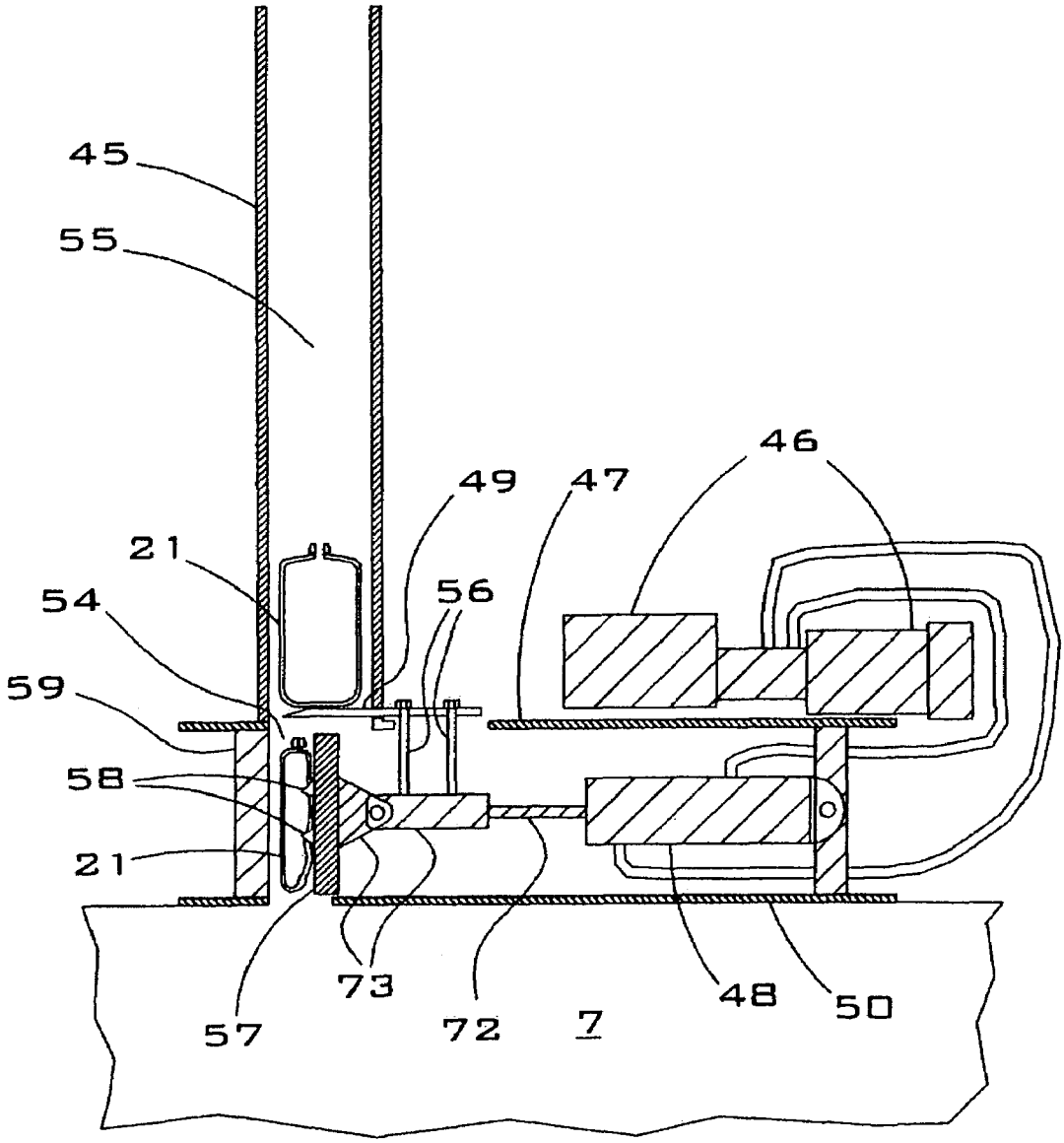
FIG. 18 is a section view of the bottle crusher with one bottle in the crushing area and one bottle in the feed area of the bottle crusher tube.

FIG. 18 is a section view of the bottle crusher with one bottle in the crushing area and one bottle in the feed area of the bottle crusher tube. Once the sliding plate 49 is retracted, the next bottle in line falls into the crushing area 54. The sliding plate 49 keeps the rest of the bottles in the feed area 55 of the bottle crusher tube 45. The sliding plate 49 is connected to the connecting member 73 by two lateral posts 56. The connecting member 73, in turn, is attached to the hydraulic ram 72, which is moved by the hydraulic cylinder 48. The connecting member 73 is also attached to a crushing face 57, which comprises a plurality of spikes 58. As the hydraulic ram 72 moves the crushing face 57 toward the bottle 21, the spikes 58 puncture the side of the bottle, and the bottle is crushed against a backstop 59. As the crushing face 57 pulls away from the bottle 21, the bottle falls through an opening in the trailer floor (or deck) 50 and into the crushed bottle storage compartment 7.

The second switch 53 on the outside of the housing 47 is positioned so that the crushing face 57 crushes the bottle to less than one and one-half inches thick. The first switch 52 is positioned so that the sliding plate will retract until it is just outside the bottle crusher tube 45 and then start moving in the other direction. The speed of the sliding plate is adjusted so that the next bottle has enough time to fall down into the crushing area 54 when the sliding plate 49 is retracted.

Figure 19:
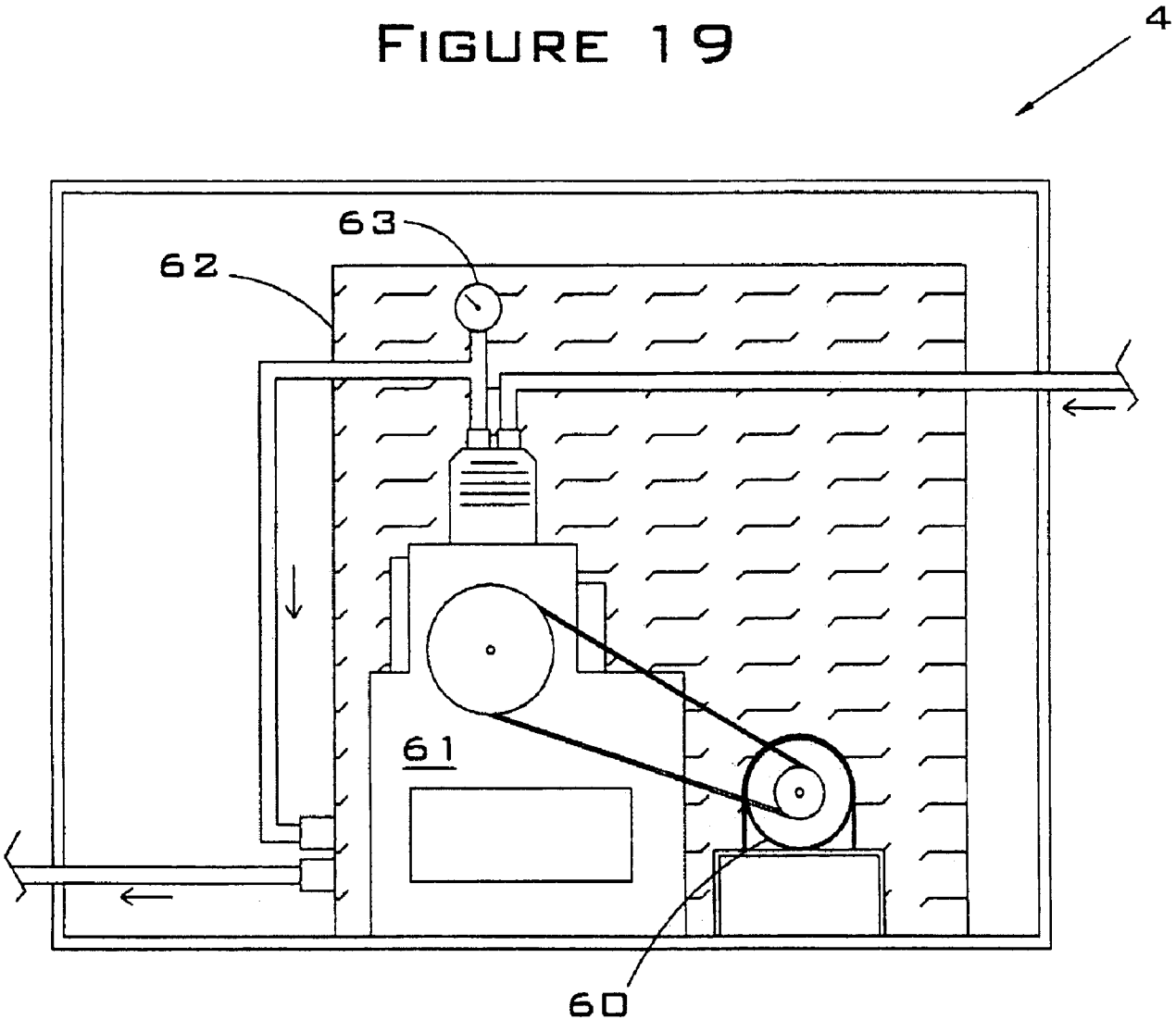
FIG. 19 is a side view of the components inside the compressor box.

FIG. 19 is a side view of the components inside the compressor box. The compressor box 4 houses the compressor motor 60, the compressor 61, and the optional heat exchanger 62. Gaseous propane flows from the second propane collection tank 3 (not shown) into the compressor, where the propane is pressurized and returned to a liquid state. The exact point at which the propane transitions from a gaseous to a liquid form depends on various factors, including temperature and elevantion. The compressor is responsible for maintaining the vacuum on the inlet side of the compressor and for maintaining high pressure on the outlet side. Because pressurization of the propane produces some heat, the heat exchanger cools the propane before it is stored in the liquid propane storage tank 5 (not shown). A gauge 63 on the compressor allows the operator to confirm that liquid propane is being produced and to ensure that the pressure on the outlet side of the compressor does not become too high.

The present invention may also be modified to accommodate non-conforming or odd-shaped propane bottles (i.e., anything other than a standard one-pound propane bottle). To provide this added feature, an auxiliary hose may be added to the first main hose 17 between the propane manifold 17 and the first propane collection tank 2. A manual valve and various bottle attachments can be attached to the auxiliary hose to allow draining of propane bottles that will not fit in the bottle manifold 13. The propane that is drained from these bottles enters the vacuum line and is processed in the same manner described above.

Figure 20:
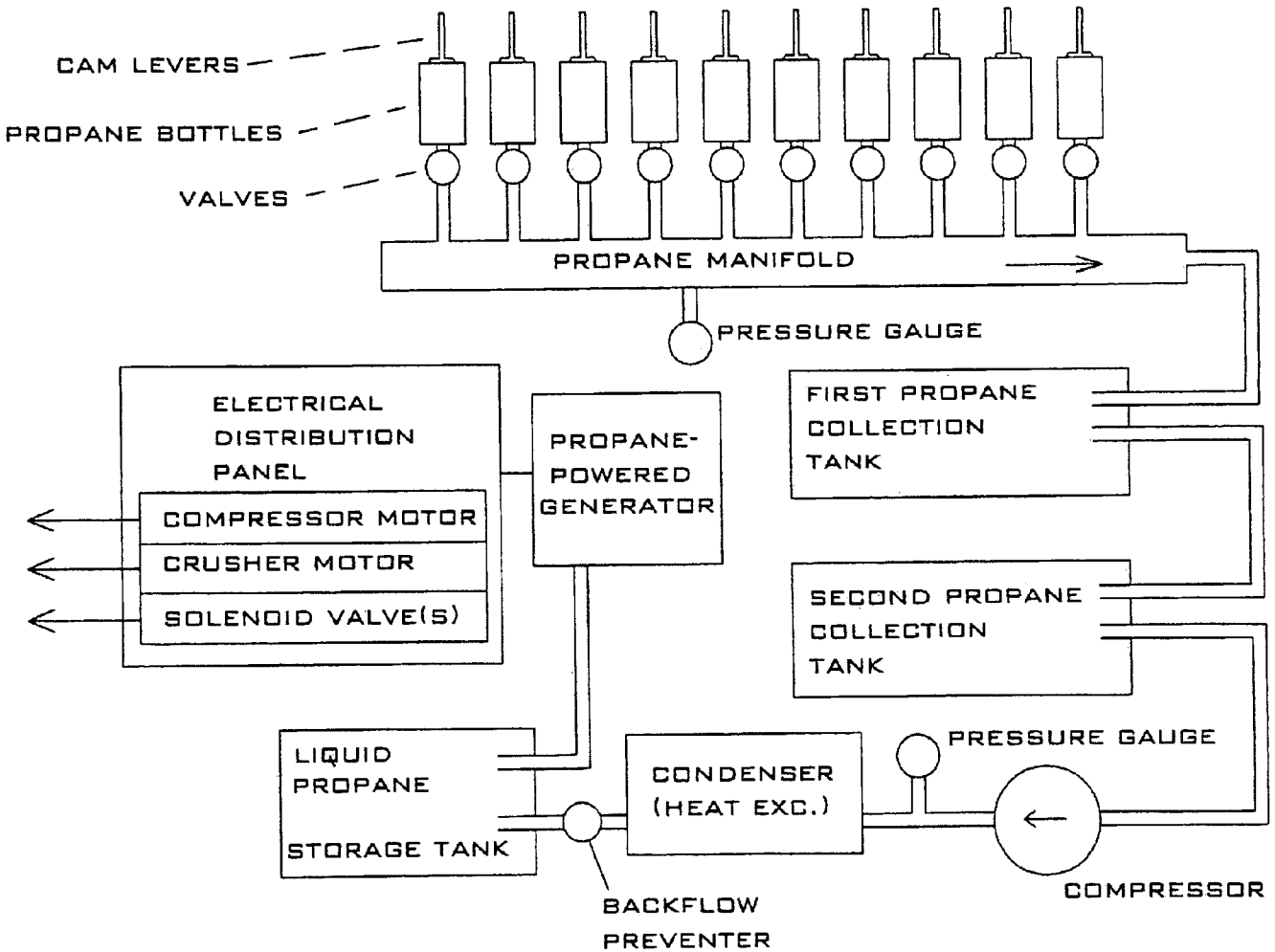
FIG. 20 is a schematic diagram showing the flow of propane in the present invention.

FIG. 20 is a schematic diagram showing the flow of propane in the present invention. As illustrated in this figure, the propane is drained from the propane bottles through the valves (either solenoid or one-way valves, as described above), into the propane manifold. From there, the propane goes into the first propane collection tank, the second propane collection tank (optional), and into the compressor. On the other side of the compressor, the repressurized propane passes through the heat exchanger (optional) and into the liquid propane storage tank. From there, the propane may be used to run the propane-powered generator, which in turn runs the compressor motor, the hydraulic motor for the bottle crusher, and the solenoid valves on the bottle station.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A propane bottle recycler comprising:

a) a bottle station, the bottle station comprises:

a bottle station frame, a bottle manifold is pivotally connected to the bottle station frame so that the bottle manifold can be raised to a vertical position or lowered to a horizontal position, the bottle manifold comprises a bottle header and a plurality of bottle cradles, the bottle header comprises a plurality of receiving cavities, a plurality of propane hoses, and a propane manifold;

b) a first propane collection tank;

c) a liquid propane storage tank;

d) a compressor;

e) a bottle crusher; and f) a crushed bottle storage compartment, wherein the sides of the receiving cavities are not threaded, wherein the number of the receiving cavities equals the number of the bottle cradles, wherein the number of the propane hoses equals the number of the bottle cradles, wherein one or more propane bottles is/are placed in the bottle cradle(s) when the bottle manifold is in the horizontal position, with one propane bottle per bottle cradle, wherein each propane bottle comprises a mouth, wherein the mouth of each propane bottle is inserted into the respective receiving cavities, wherein each receiving cavity comprises a propane evacuation nipple, wherein the bottle manifold is raised to the vertical position so that the bottle mouths are facing downward, wherein the propane from each bottle flows through the propane evacuation nipples, through a valve on the opposite side of the bottle header, and into one of the propane hoses, wherein the propane flows from the propane hoses into the propane manifold, wherein the propane flows from the propane manifold into the first propane collection tank, wherein the propane flows from the first propane collection tank into the compressor, wherein the propane is in gaseous form when it flows into the compressor, wherein the compressor repressurizes the propane into liquid form, and wherein the liquid propane flows from the compressor into the liquid propane storage tank.

2. The propane bottle recycler of claim 1, further comprising a means for holding the bottles in place in the bottle cradles.

3. The propane bottle recycler of claim 2, wherein the means for holding the bottles in place in the bottle cradles is a plurality of cam levers, and wherein the number of cam levers equals the number of bottle cradles.

4. The propane bottle recycler of claim 3, wherein each cam lever comprises a rod and a rubber stopper.

5. The propane bottle recycler of claim 2, wherein the means for holding the bottles in place in the bottle cradles is a plurality of spring-loaded plungers, and wherein the number of spring-loaded plungers equals the number of bottle cradles.

6. The propane bottle recycler of claim 1, further comprising a heat exchanger, wherein the heat exchanger is positioned between the compressor and the liquid propane storage tank, and wherein the heat exchanger reduces the temperature of the propane as it exits the compressor.

7. The propane bottle recycler of claim 1, further comprising a second propane collection tank, wherein the second propane collection tank is positioned between the first propane collection tank and the compressor, and wherein the propane flows from the first propane collection tank into the second propane collection tank and then into the compressor.

8. The propane bottle recycler of claim 1, further comprising a plurality of solenoid valves, wherein the number of solenoid valves equals the number of bottle cradles, wherein there is a solenoid valve located on the opposite side of the bottle header from each receiving cavity, and wherein the solenoid valves control the flow of propane from the propane bottles into the propane hoses.

9. The propane bottle recycler of claim 8, wherein the solenoid valves are controlled by an electrical switch, and wherein the switch is activated when the bottle manifold is raised to a vertical position.

10. The propane bottle recycler of claim 8, wherein the compressor creates a vacuum between the solenoid valves and the compressor.

11. The propane bottle recycler of claim 1, further comprising a plurality of one-way valves and a single solenoid valve, wherein the number of one-way valves equals the number of bottle cradles, wherein there is a one-way valve located on the opposite side of the bottle header from each receiving cavity, wherein the one-way valves allow the propane to flow out of the propane bottles and into the propane hoses but prevent the propane from traveling in the opposite direction, and wherein the solenoid valve controls the flow of propane from the propane manifold into the first propane collection tank.

12. The propane bottle recycler of claim 11, wherein the solenoid valve is controlled by an electrical switch, and wherein the switch is activated when the bottle manifold is raised to a vertical position.

13. The propane bottle recycler of claim 11, wherein the compressor creates a vacuum between the solenoid valves and the compressor.

14. The propane bottle recycler of claim 1, wherein the bottle crusher comprises a bottle crusher tube, a hydraulic motor, a hydraulic cylinder, a hydraulic ram, a sliding plate, a first switch, a second switch, a crushing area, a feed area, a lateral post, a crushing face, and a backstop, wherein the bottle manifold is lowered to the horizontal position and the bottles are removed from the bottle cradles and placed into the bottle crusher tube after the propane is drained from the bottles, wherein when one or more bottle(s) is/are placed inside the bottle crusher tube, one bottle will fall down into the crushing area, wherein the sliding plate prevents more than one propane bottle from being in the crushing area at a time, wherein the sliding plate moves back and forth in a horizontal direction, and when the sliding plate is withdrawn from the bottle crusher tube, the next bottle in line falls into the crushing area, wherein the movement of the sliding plate is controlled by the first and second switches, wherein the crushing face is located directly underneath the sliding plate, wherein the sliding plate and crushing face are both moved by the hydraulic ram, wherein the hydraulic ram is moved by the hydraulic cylinder, wherein the hydraulic cylinder is powered by the hydraulic motor, wherein the crushing face comprises one or more spike(s), wherein the spike(s) puncture the side of the propane bottle that is located in the crushing area and the crushing face crushes the bottle against the backstop, and wherein when the crushing face moves away from the crushed bottle, the crushed bottle falls into a crushed bottle storage compartment.

15. The propane bottle recycler of claim 14, wherein the crushed bottle storage compartment is located in the bottom of a trailer that can be pulled by a pick-up truck or similar vehicle.

16. The propane bottle recycler of claim 14, wherein the propane bottle recycler is situated on top of a deck, and wherein the crushed bottle storage compartment is located underneath the deck, directly beneath the bottle crusher tube of the bottle crusher.

17. The propane bottle recycler of claim 1, wherein the number of bottle cradles is ten.

18. The propane bottle recycler of claim 1, wherein the bottle cradles are sized to fit one-pound propane bottles.

19. The propane bottle recycler of claim 1, further comprising an auxiliary port for draining propane bottles or tanks that do not fit in the bottle cradles.

* * * * *